US007461430B2

(12) United States Patent
Reick-Mitrisin et al.

(10) Patent No.: US 7,461,430 B2
(45) Date of Patent: Dec. 9, 2008

(54) VACUUM SYSTEM AND METHOD

(75) Inventors: Christian Reick-Mitrisin, Liberty Township, OH (US); Robert K. Hasty, Union, KY (US); Stephen E. Hutchinson, Amelia, OH (US); Gordon Thomas, Mason, OH (US); Tom Remm, Milford, OH (US); William Thorn, Middletown, OH (US); Mike Jones, Loveland, OH (US)

(73) Assignee: Broan-NuTone LLC, Hartford, WI (US)

( * ) Notice: Subject to any disclaimer, the term of this patent is extended or adjusted under 35 U.S.C. 154(b) by 670 days.

(21) Appl. No.: 11/032,511

(22) Filed: Jan. 10, 2005

(65) Prior Publication Data

US 2006/0150360 A1 Jul. 13, 2006

(51) Int. Cl.
*A47L 5/38* (2006.01)
*A47L 9/14* (2006.01)

(52) U.S. Cl. ..... 15/323; 15/314

(58) Field of Classification Search ..... 15/314, 15/323, 352, 301
See application file for complete search history.

(56) References Cited

U.S. PATENT DOCUMENTS

| | | | | |
|---|---|---|---|---|
| 2,253,310 | A | 8/1941 | Smellie | |
| 2,884,185 | A | 4/1959 | Dolan | |
| 3,213,480 | A * | 10/1965 | Miller | 15/314 |
| D205,759 | S | 9/1966 | Mers | |
| 3,358,316 | A | 12/1967 | Okun | |
| 3,570,809 | A | 3/1971 | Stuy | |
| 3,882,961 | A | 5/1975 | Cannan et al. | |
| 3,975,790 | A | 8/1976 | Patterson | |
| 4,015,683 | A | 4/1977 | Williams | |
| 4,072,483 | A | 2/1978 | Doyle, Jr. | |
| 4,114,231 | A | 9/1978 | Nauta | |
| 4,231,133 | A | 11/1980 | Probost | |
| 4,241,720 | A | 12/1980 | Kitchen | |
| 4,268,288 | A | 5/1981 | Coombs | |
| 4,280,245 | A | 7/1981 | Hiester | |
| 4,330,899 | A | 5/1982 | Miller et al. | |
| 4,356,591 | A | 11/1982 | Lude | |
| 4,361,928 | A | 12/1982 | Schulz | |
| 4,435,877 | A | 3/1984 | Berfield | |

(Continued)

FOREIGN PATENT DOCUMENTS

CA 1285886 7/1991

(Continued)

OTHER PUBLICATIONS

PCT/US06/00644 International Search Report dated Jan. 17, 2008.

(Continued)

*Primary Examiner*—David B Thomas
(74) *Attorney, Agent, or Firm*—Michael Best & Friedrich LLP

(57) ABSTRACT

A central vacuum system connectable to an interior portion of an inhabitable structure includes a housing having an upper end, a lower end, and a side wall defining a collection chamber, the side wall defining an opening communicating between atmosphere and the collection chamber, and a vacuum motor supported in the housing and being operable to move debris from the interior portion into the collection chamber.

32 Claims, 25 Drawing Sheets

U.S. PATENT DOCUMENTS

| | | | | | |
|---|---|---|---|---|---|
| 4,651,380 | A | | 3/1987 | Ogden | |
| 4,662,910 | A | | 5/1987 | Lieb | |
| 4,665,581 | A | | 5/1987 | Oberdorfer | |
| 4,718,924 | A | | 1/1988 | DeMarco | |
| D294,187 | S | | 2/1988 | Bertuzzo | |
| 4,759,422 | A | | 7/1988 | Belley | |
| 4,786,299 | A | | 11/1988 | DeMarco | |
| 4,938,309 | A | | 7/1990 | Emdy | |
| 5,020,186 | A | * | 6/1991 | Lessig et al. | 15/339 |
| 5,028,245 | A | * | 7/1991 | Stein et al. | 55/373 |
| 5,035,586 | A | | 7/1991 | Sadler et al. | |
| 5,089,038 | A | * | 2/1992 | Kopco et al. | 55/374 |
| 5,267,371 | A | | 12/1993 | Soler et al. | |
| D349,369 | S | | 8/1994 | Adams | |
| 5,353,469 | A | | 10/1994 | Fellhauer | |
| 5,400,463 | A | | 3/1995 | Attard et al. | |
| 5,468,271 | A | * | 11/1995 | Sauer et al. | 55/357 |
| 5,471,707 | A | | 12/1995 | Kang | |
| 5,544,385 | A | | 8/1996 | Jailor et al. | |
| 5,720,074 | A | | 2/1998 | Lee | |
| 5,725,619 | A | * | 3/1998 | Brule et al. | 55/367 |
| 5,737,797 | A | | 4/1998 | Rittmueller et al. | |
| 5,774,930 | A | | 7/1998 | Sommer et al. | |
| D398,426 | S | | 9/1998 | Bisson | |
| 5,813,085 | A | | 9/1998 | Fritz et al. | |
| 5,926,908 | A | | 7/1999 | Lindsay, Jr. | |
| 6,014,791 | A | | 1/2000 | Nosenchuck | |
| 6,052,863 | A | | 4/2000 | Rittmueller et al. | |
| 6,077,032 | A | | 6/2000 | Wolfe, Jr. et al. | |
| 6,094,774 | A | | 8/2000 | Larsen et al. | |
| 6,158,080 | A | | 12/2000 | Schlapkohl | |
| D446,365 | S | | 8/2001 | Bisson | |
| 6,363,574 | B2 | | 4/2002 | Worden et al. | |
| D459,039 | S | | 6/2002 | Bisson | |
| 6,502,274 | B1 | | 1/2003 | Harrelson, II | |
| 6,560,816 | B1 | * | 5/2003 | Harrelson, II | 15/314 |
| 6,733,555 | B1 | * | 5/2004 | Wilder | 55/367 |
| 6,746,501 | B1 | * | 6/2004 | Wilder et al. | 55/367 |
| 6,804,857 | B1 | | 10/2004 | Olewiler | |
| D506,298 | S | | 6/2005 | Schmitt | |
| D518,927 | S | | 4/2006 | Rupp et al. | |
| 7,080,425 | B2 | * | 7/2006 | Smith et al. | 15/327.6 |
| D534,697 | S | | 1/2007 | Reick-Mitrisin et al. | |
| D537,580 | S | | 2/2007 | Zimmerle et al. | |
| D537,582 | S | | 2/2007 | Zimmerle et al. | |
| D537,583 | S | | 2/2007 | Crevling et al. | |
| 7,191,488 | B2 | * | 3/2007 | Jonsson | 15/314 |
| 2002/0178531 | A1 | | 12/2002 | Plomteux et al. | |
| 2002/0178536 | A1 | | 12/2002 | Valentini | |
| 2003/0132634 | A1 | | 7/2003 | Biere et al. | |
| 2005/0022335 | A1 | * | 2/2005 | Gerth et al. | 15/352 |
| 2005/0039295 | A1 | | 2/2005 | Werning | |
| 2005/0081323 | A1 | * | 4/2005 | Nam et al. | 15/352 |

FOREIGN PATENT DOCUMENTS

| | | |
|---|---|---|
| DE | 19739613 | 3/1998 |
| GB | 2312159 | 10/1997 |
| WO | WO 9939621 | 8/1999 |

OTHER PUBLICATIONS

Website advertisement entitled "Central Vacuum Stores", visited Mar. 22, 2004.

PCT/US07/09827 International Search Report and Written Opinion dated Nov. 14, 2007.

* cited by examiner

VACUUM SYSTEM AND METHOD

FIELD OF THE INVENTION

The present invention relates to vacuum systems and, more particularly, to a central vacuum system for an inhabitable structure.

BACKGROUND

Central vacuum systems are often mounted in inhabitable structures, such as, for example, homes, commercial buildings, and the like. In many cases, central vacuum systems include a system of ducts, which extend throughout the structure into various rooms of the structure. Vacuum hoses or nozzles can be connected to the ducts to collect debris. Central vacuum systems generally include a housing supporting a vacuum motor which draws debris through the hoses and the ducts and into a collection chamber.

SUMMARY

Some embodiments of the present invention provide a central vacuum system connectable to an interior portion of an inhabitable structure. In some embodiments, the central vacuum system includes a housing having an upper end, a lower end, and a side wall defining a collection chamber, the side wall defining an opening communicating between atmosphere and the collection chamber, and a vacuum motor supported in the housing and being operable to move debris from the interior portion into the collection chamber.

In addition, some embodiments of the invention provide a vacuum bag assembly for a central vacuum system, the central vacuum system including a housing defining a collection chamber and having a bag mounting assembly extending into the collection chamber. In some embodiments, the vacuum bag assembly can include a flange connectable with the bag mounting assembly to secure the bag in the collection chamber, the flange defining an inlet and supporting a cover, the cover being moveable relative to the flange between a closed position, in which the cover substantially covers the inlet, and an opened position, in which at least a portion of the cover is moved away from the inlet. The cover can be connectable to the bag mounting assembly so that, when the flange is disconnected from the bag mounting assembly, the cover is moved between the opened position and the closed position.

Some embodiments of the invention provide a central vacuum system including a housing having a wall defining a collection chamber, a bag mounting assembly extending into the collection chamber, a bag having a flange connectable with the bag mounting assembly to secure the bag in the collection chamber, the flange defining an inlet and supporting a cover, the cover being moveable relative to the flange between a closed position, in which the cover substantially covers the inlet, and an opened position, in which at least a portion of the cover is moved away from the inlet, and a vacuum motor supported in the housing and being operable to move debris from the interior portion into the bag. The cover can be connectable to the bag mounting assembly so that when the flange is removed from the bag mounting assembly, the cover is moved between the opened position and the closed position.

In addition, some embodiments of the invention provide a method of operating a central vacuum system connectable to an interior portion of an inhabitable structure, the central vacuum system including a housing having an upper end, a lower end, and a side wall defining a collection chamber, the side wall defining an opening communicating between atmosphere and the collection chamber. Some embodiments include the acts of providing a vacuum motor supported in the housing, inserting a bag into the collection chamber through the opening in the side wall, and directing debris from the interior portion into the bag with the vacuum motor.

Some embodiments of the invention provide a method of operating a central vacuum system connectable to an interior portion of an inhabitable structure, the central vacuum system including a housing having a wall defining a collection chamber, a vacuum motor supported in the housing, and a bag mounting assembly extending into the collection chamber. In some embodiments, the method can include the acts of inserting a bag into the collection chamber, the bag having a flange defining an inlet and supporting a cover, connecting the flange to the bag mounting assembly, moving the cover relative to the flange toward an opened position, in which the cover is moved away from the inlet, connecting the cover to the bag mounting assembly, moving debris from the interior portion into the bag with the vacuum motor, disconnecting the flange from the bag mounting assembly, and removing the bag from the collection chamber. When the flange is disconnected from the bag mounting assembly, the cover can be moved relative to the flange between the opened position and a closed position, in which the cover substantially covers the inlet.

Some embodiments of the invention provide a central vacuum system including a housing having a wall defining a collection chamber, a vacuum motor supported in the housing and being operable to move debris from the interior portion into the collection chamber, a sensor positioned in the collection chamber and being operable to record pressure data in the collection chamber, and a controller supported in the housing and being in communication with the sensor to receive the pressure data from the sensor, the controller being operable to calculate a quantity of debris in the collection chamber using the pressure data.

Some embodiments of the invention provide a method of operating a central vacuum system connectable to an interior portion of an inhabitable structure, the central vacuum including a housing having a wall defining a collection chamber, a sensor positioned in the collection chamber, and a controller supported in the housing. In these embodiments, the method includes the acts of moving debris from the interior portion into the collection chamber, recording pressure data in the collection chamber with the sensor, transmitting the pressure data from the sensor to the controller, and estimating a quantity of debris in the collection chamber using the pressure data from the sensor.

Some embodiments of the invention further provide a central vacuum system connectable to an interior portion of an inhabitable structure, including a housing having a wall defining a collection chamber and a motor housing, the motor housing having an elliptical cross section, and a vacuum motor supported in the motor housing and being operable to move debris from the interior portion into the collection chamber.

Further aspects of the present invention, together with the organization and operation thereof, will become apparent from the following detailed description of the invention when taken in conjunction with the accompanying drawings, wherein like elements have like numerals throughout the drawings.

Figure 1:
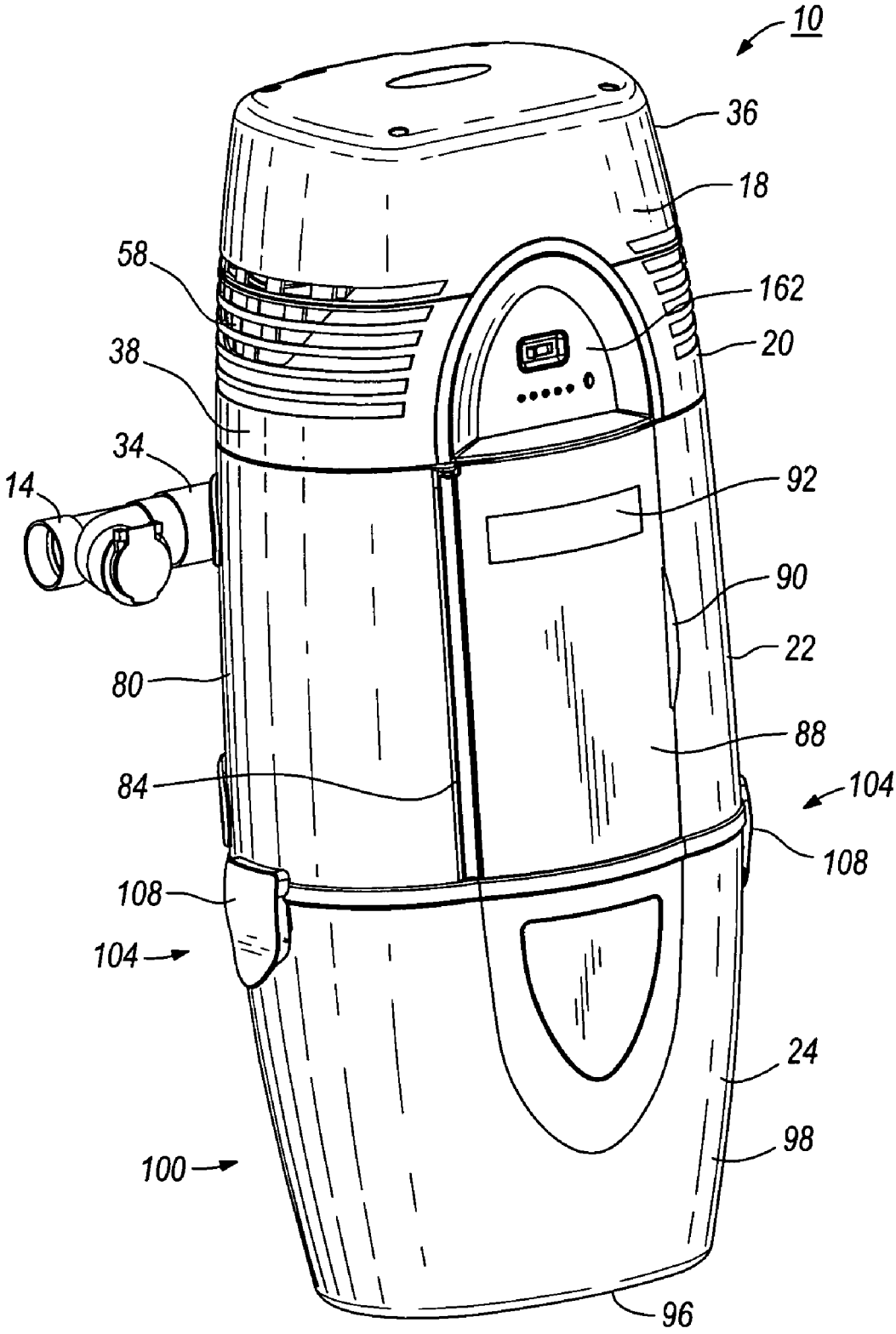
FIG. 1 is a front perspective view of a vacuum system according to an embodiment of the present invention.
Figure 2:
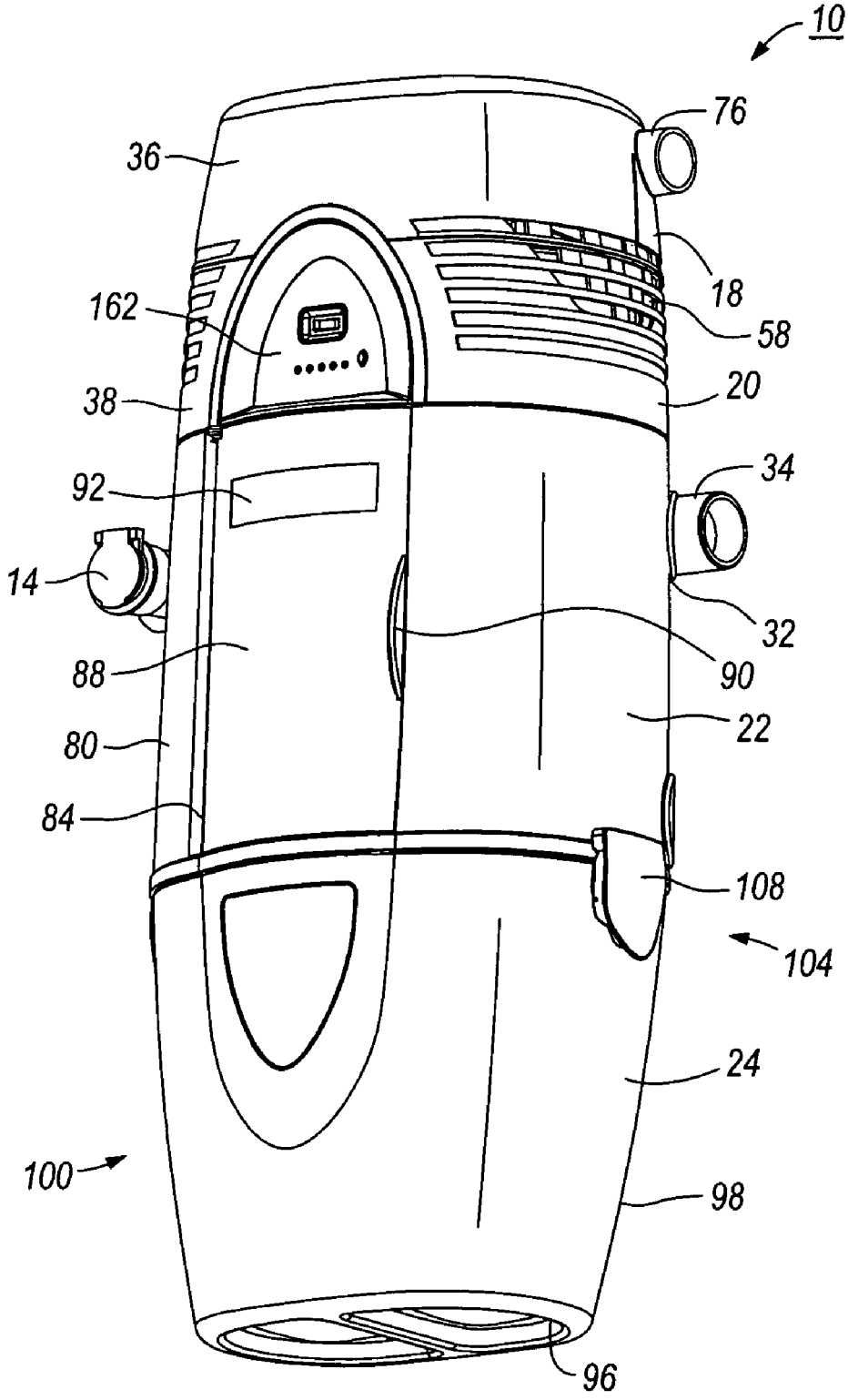
FIG. 2 is another front perspective view of the vacuum system shown in FIG. 1.
Figure 3:
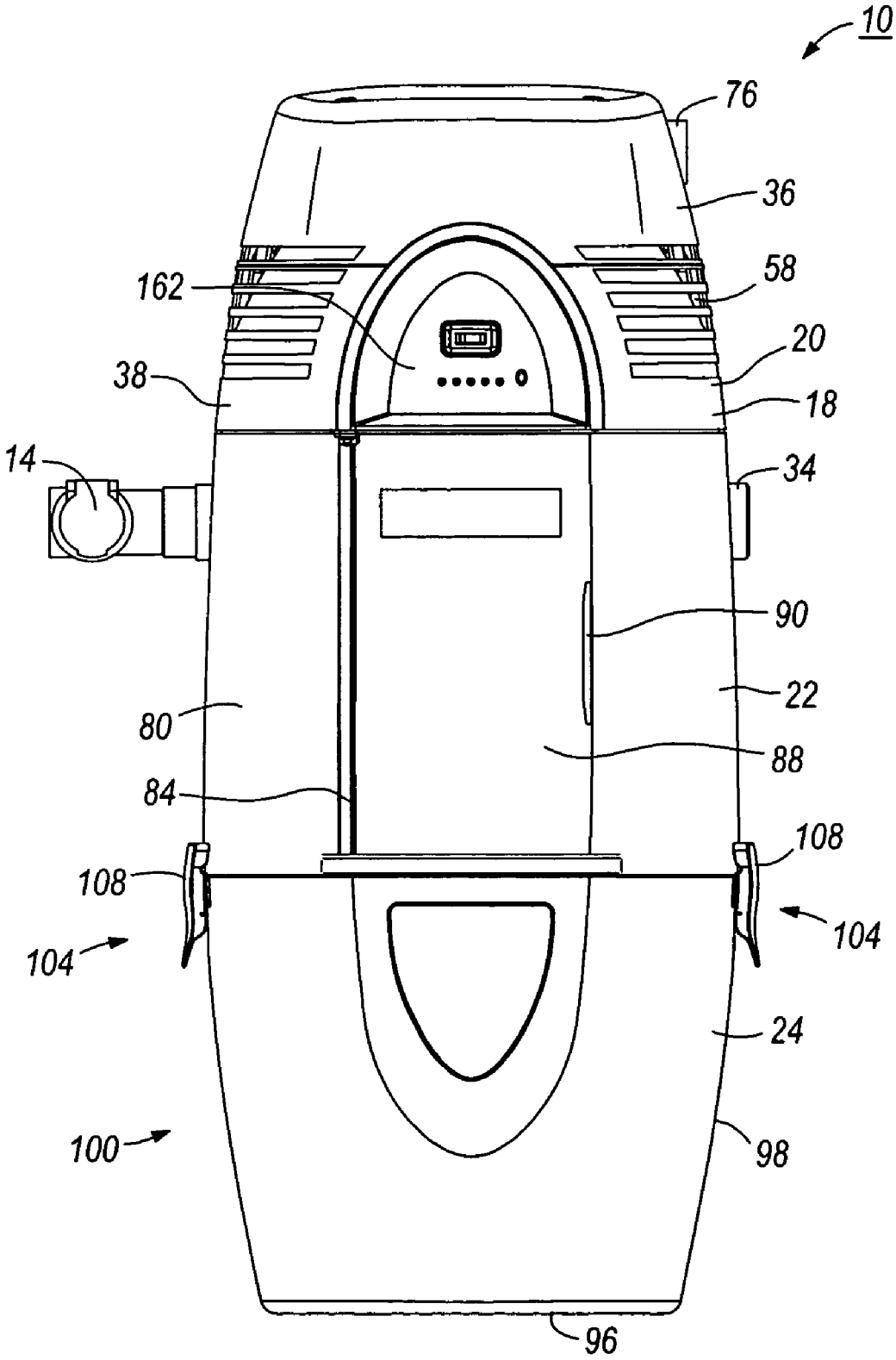
FIG. 3 is a front view of the vacuum system shown in FIG. 1.
Figure 4:
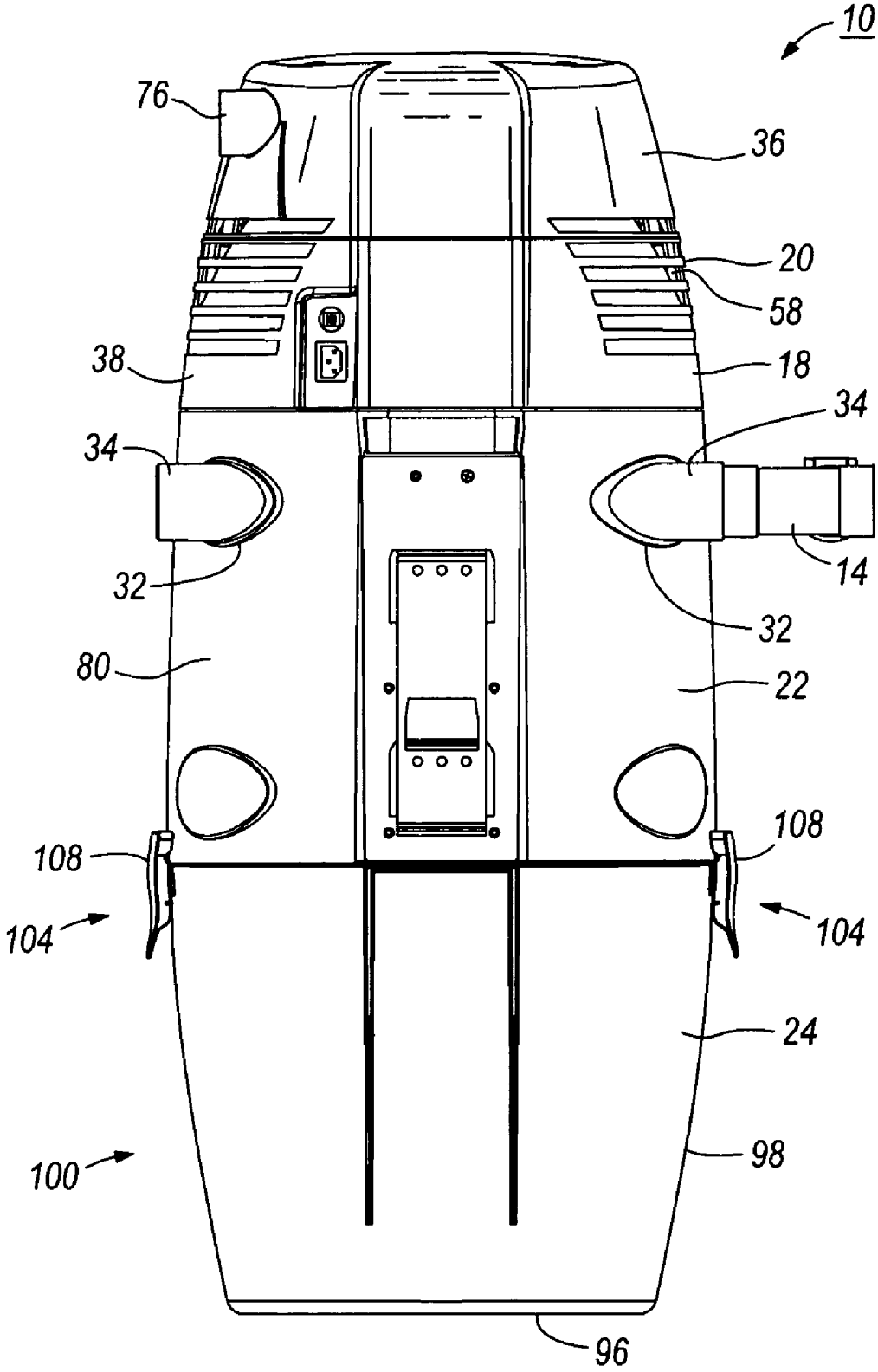
FIG. 4 is a rear view of the vacuum system shown in FIG. 1.
Figure 5:
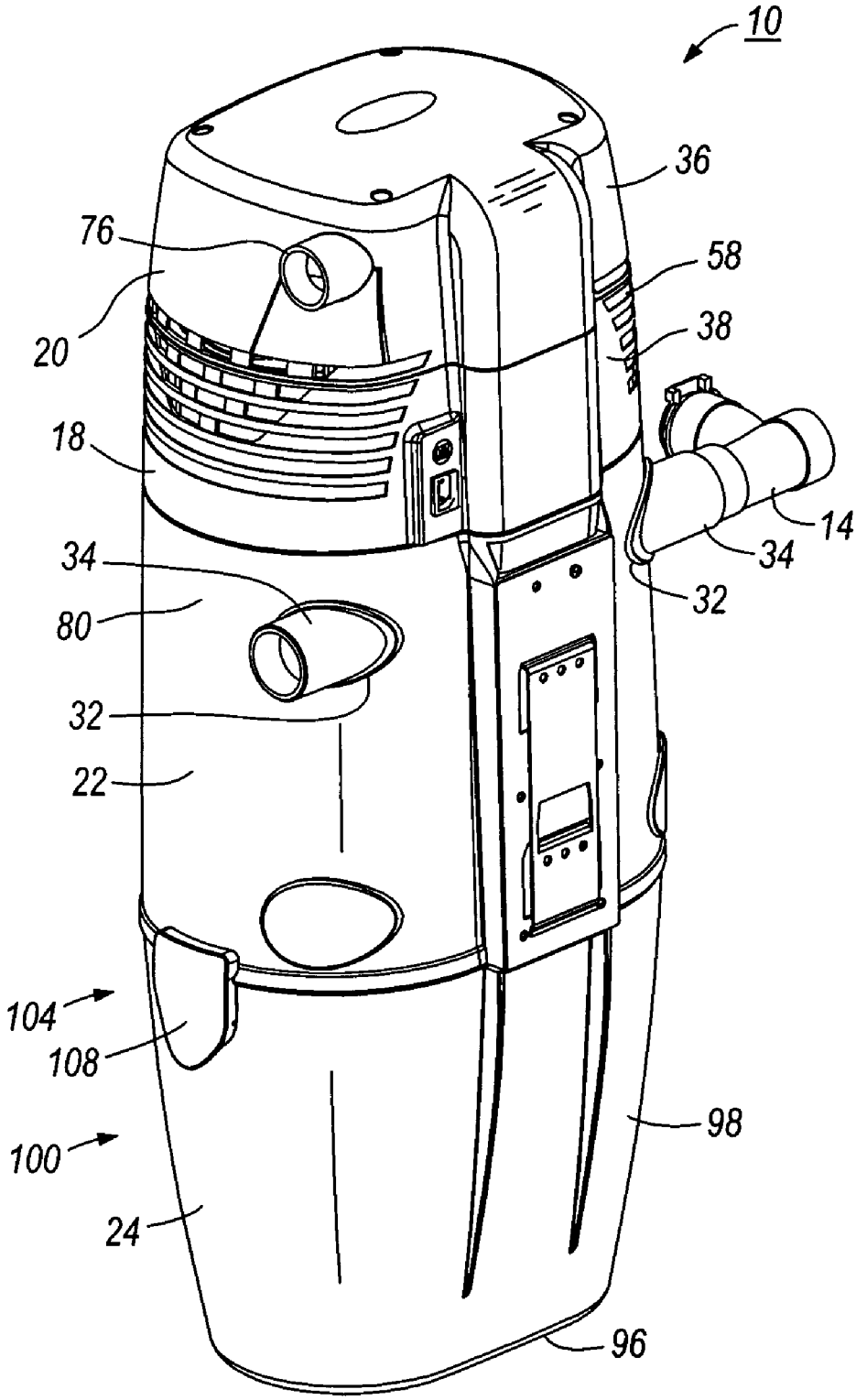
FIG. 5 is a rear perspective view of the vacuum system shown in FIG. 1.
Figure 6:
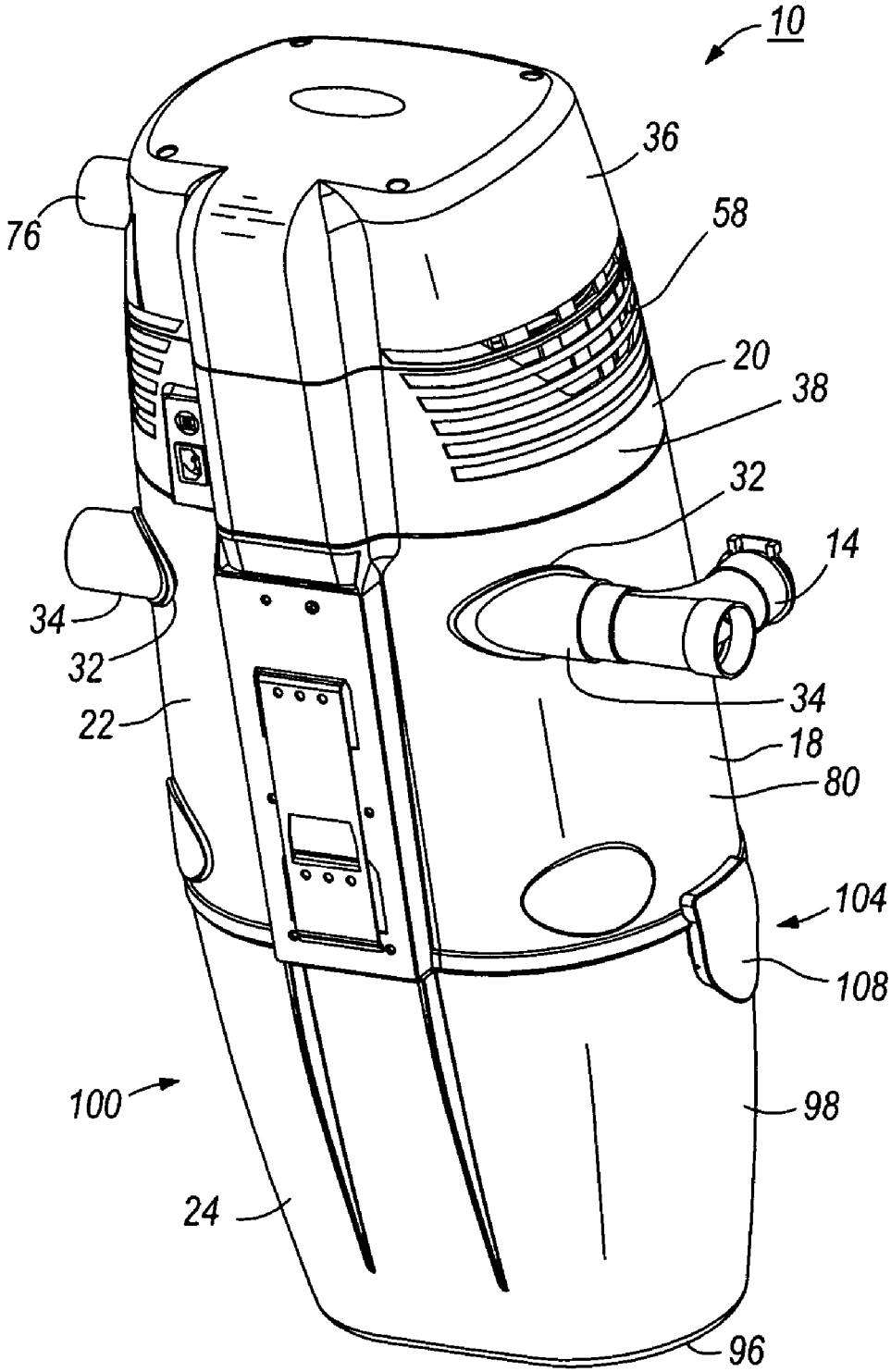
FIG. 6 is another rear perspective view of the vacuum system shown in FIG. 1.
Figure 7:
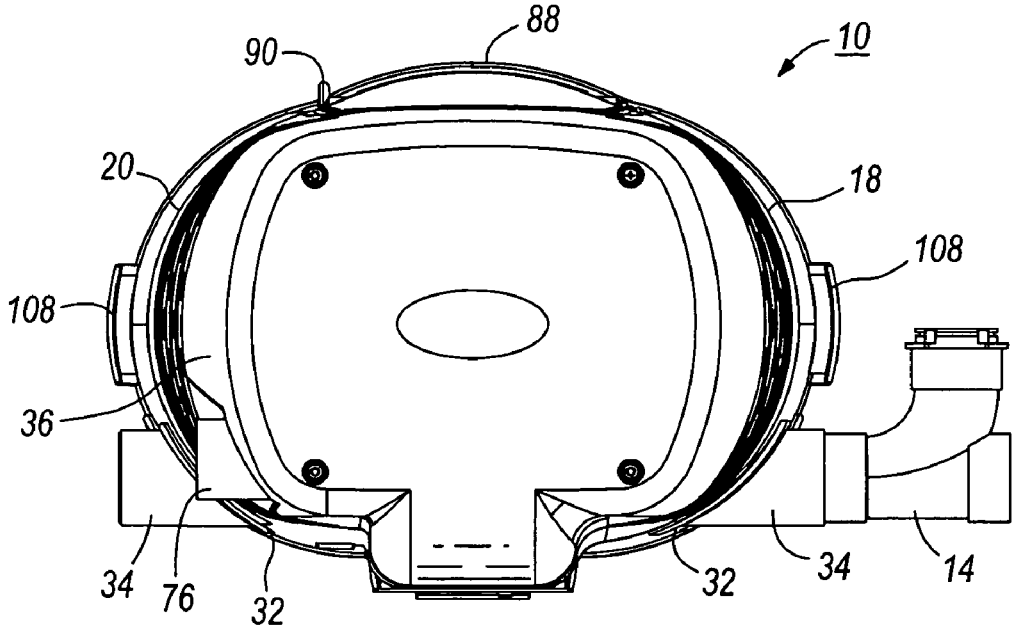
FIG. 7 is a top view of the vacuum system shown in FIG. 1.
Figure 10:
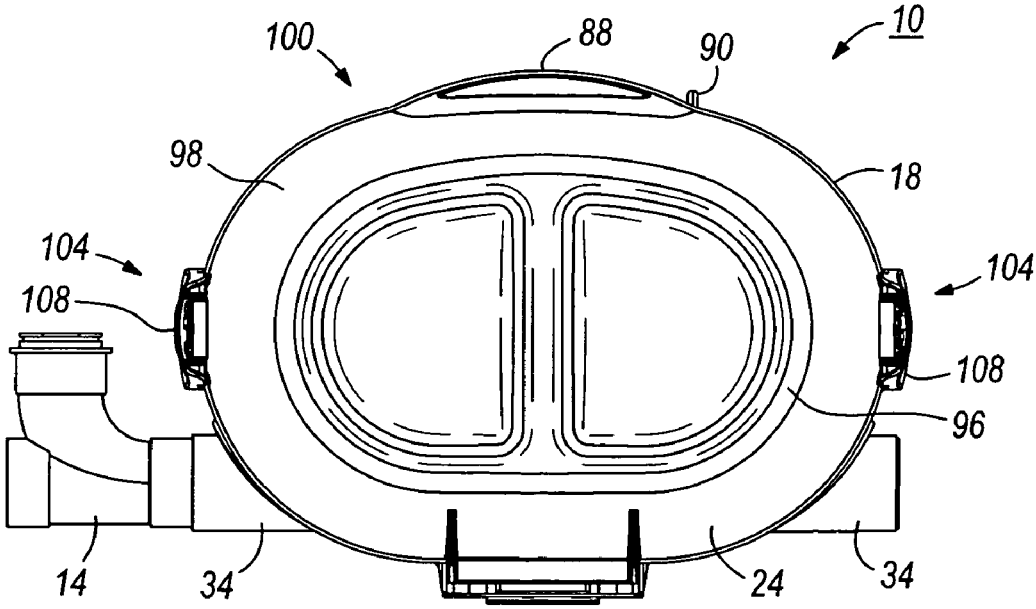
FIG. 10 is a bottom view of the vacuum system shown in FIG. 1.
Figure 8:
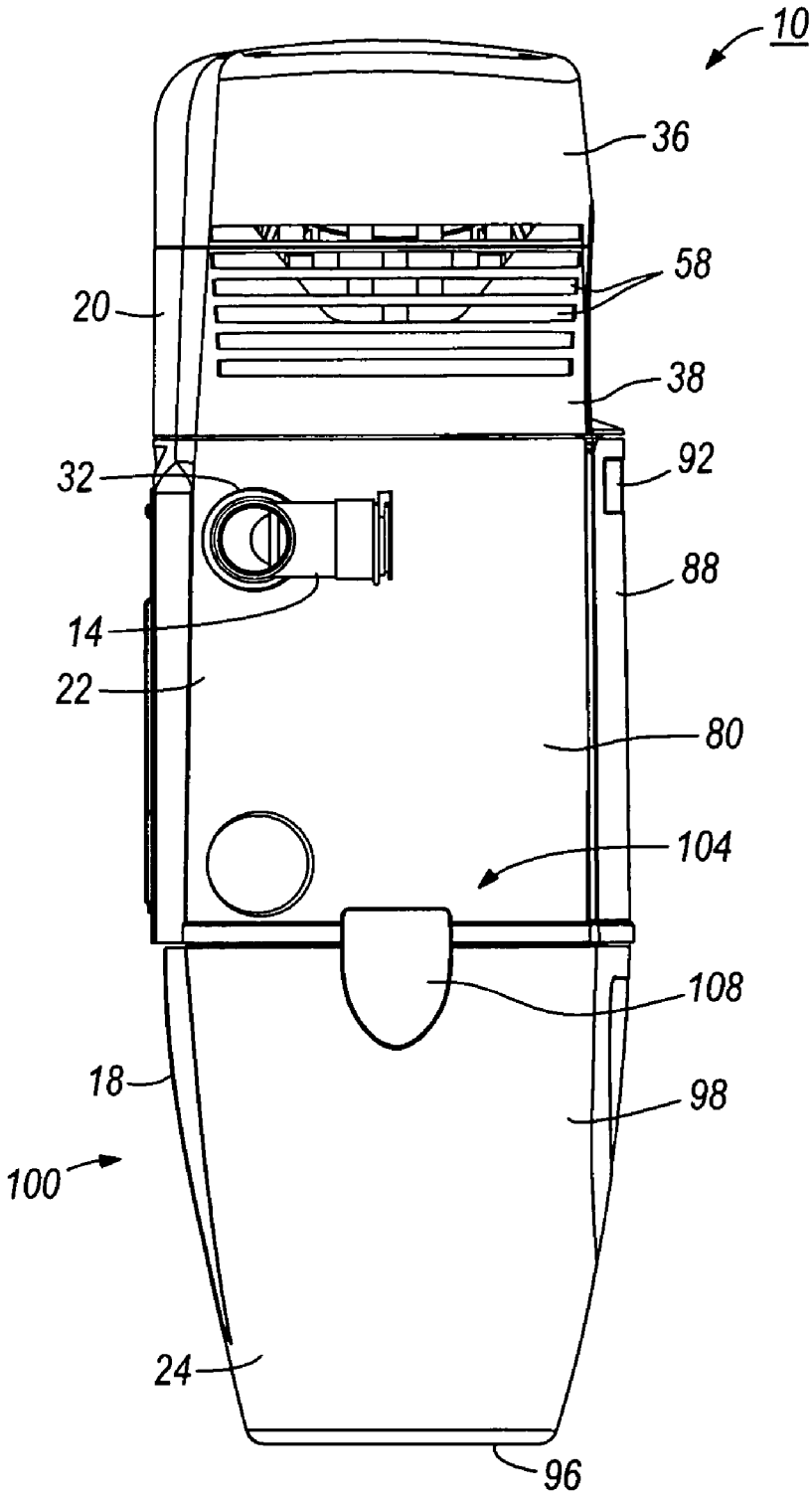
FIG. 8 is a left side view of the vacuum system shown in FIG. 1.
Figure 9:
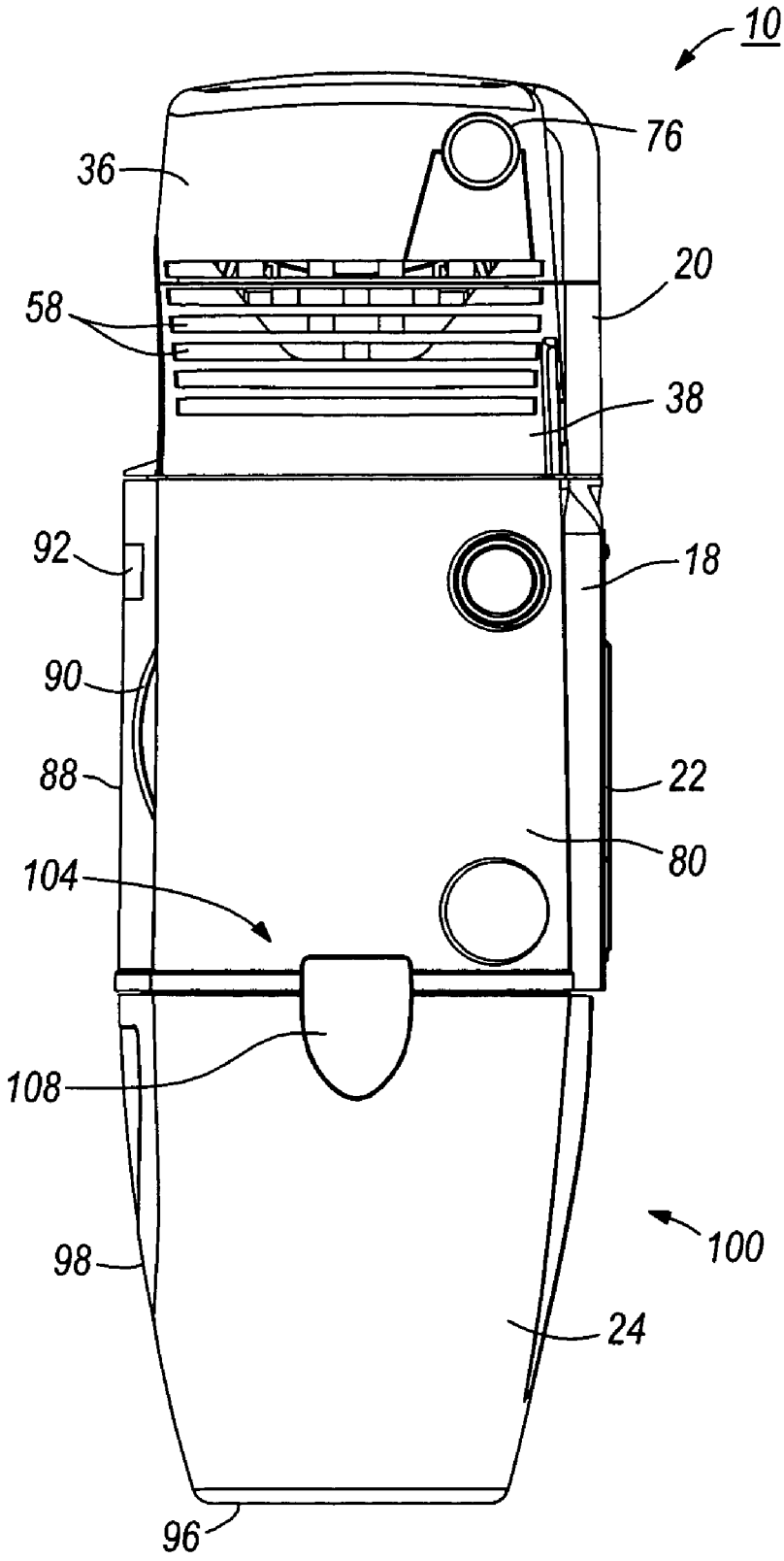
FIG. 9 is a right side view of the vacuum system shown in FIG. 1.
Figure 11:
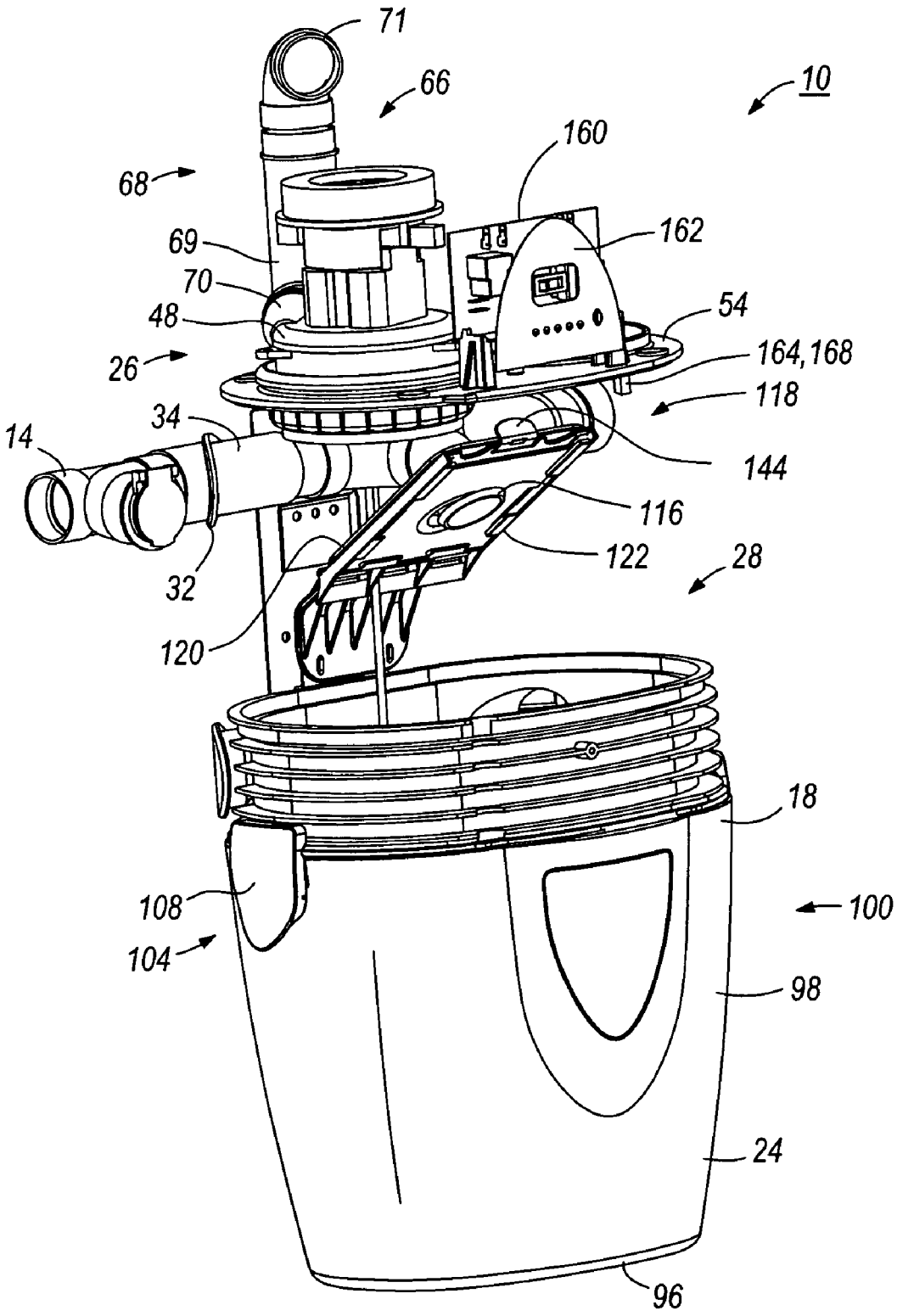
FIG. 11 is a front perspective view of the vacuum system shown in FIG. 1 with a portion of the housing removed.
Figure 12:
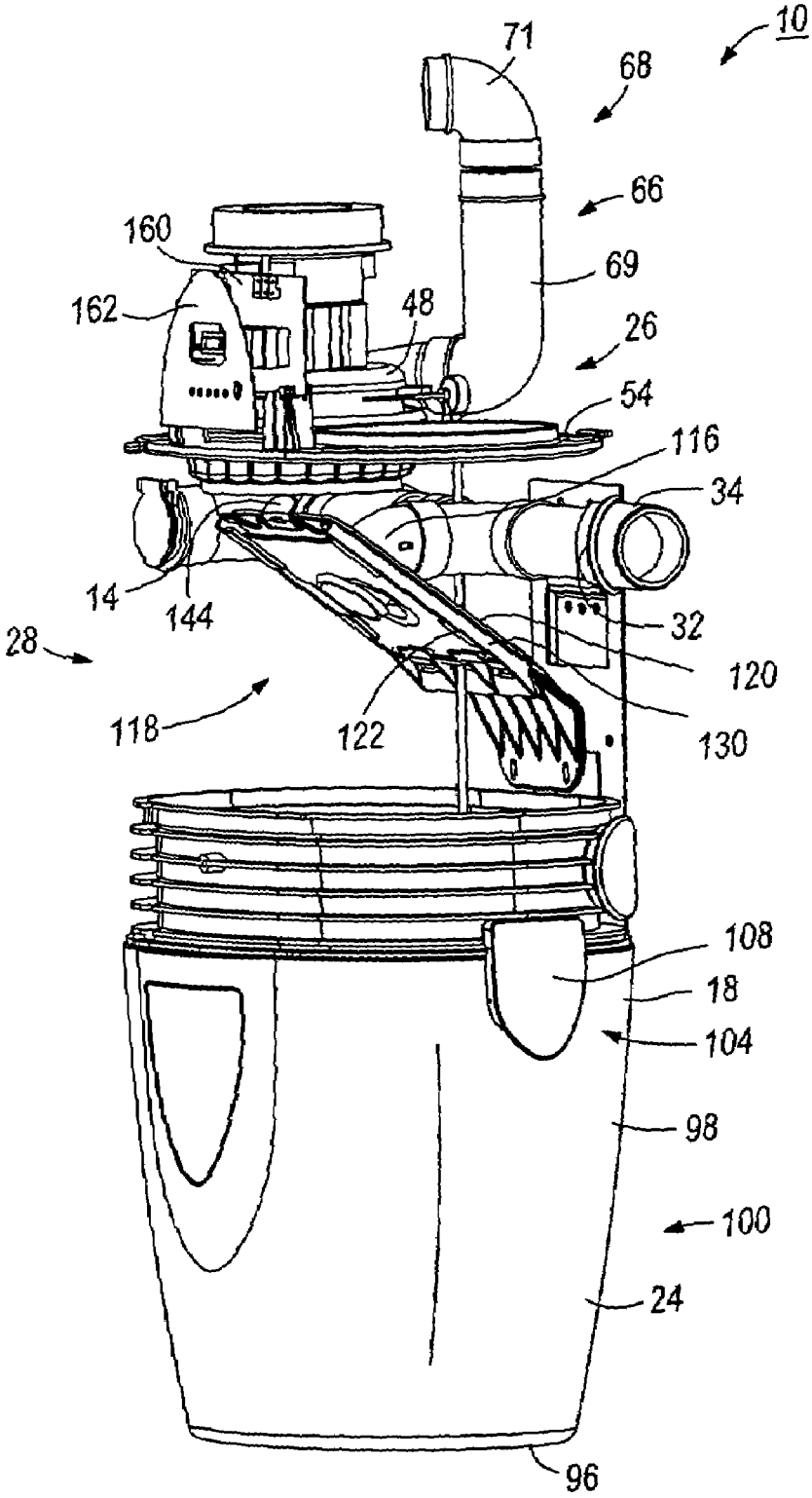
FIG. 12 is a side perspective view of the vacuum system shown in FIG. 1 with a portion of the housing removed.
Figure 13:
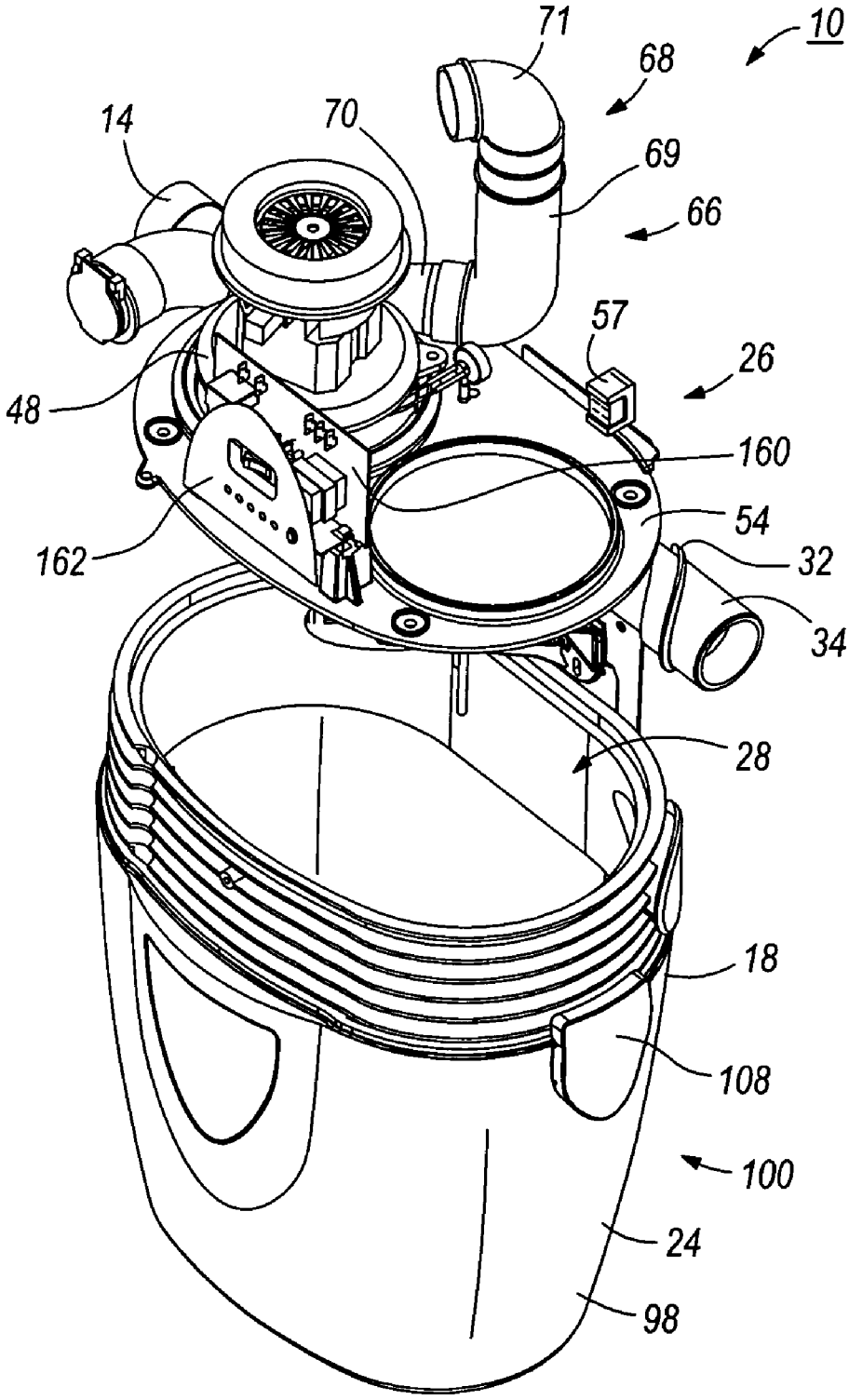
FIG. 13 is a top perspective view of the vacuum system shown in FIG. 1 with a portion of the housing removed.
Figure 14:
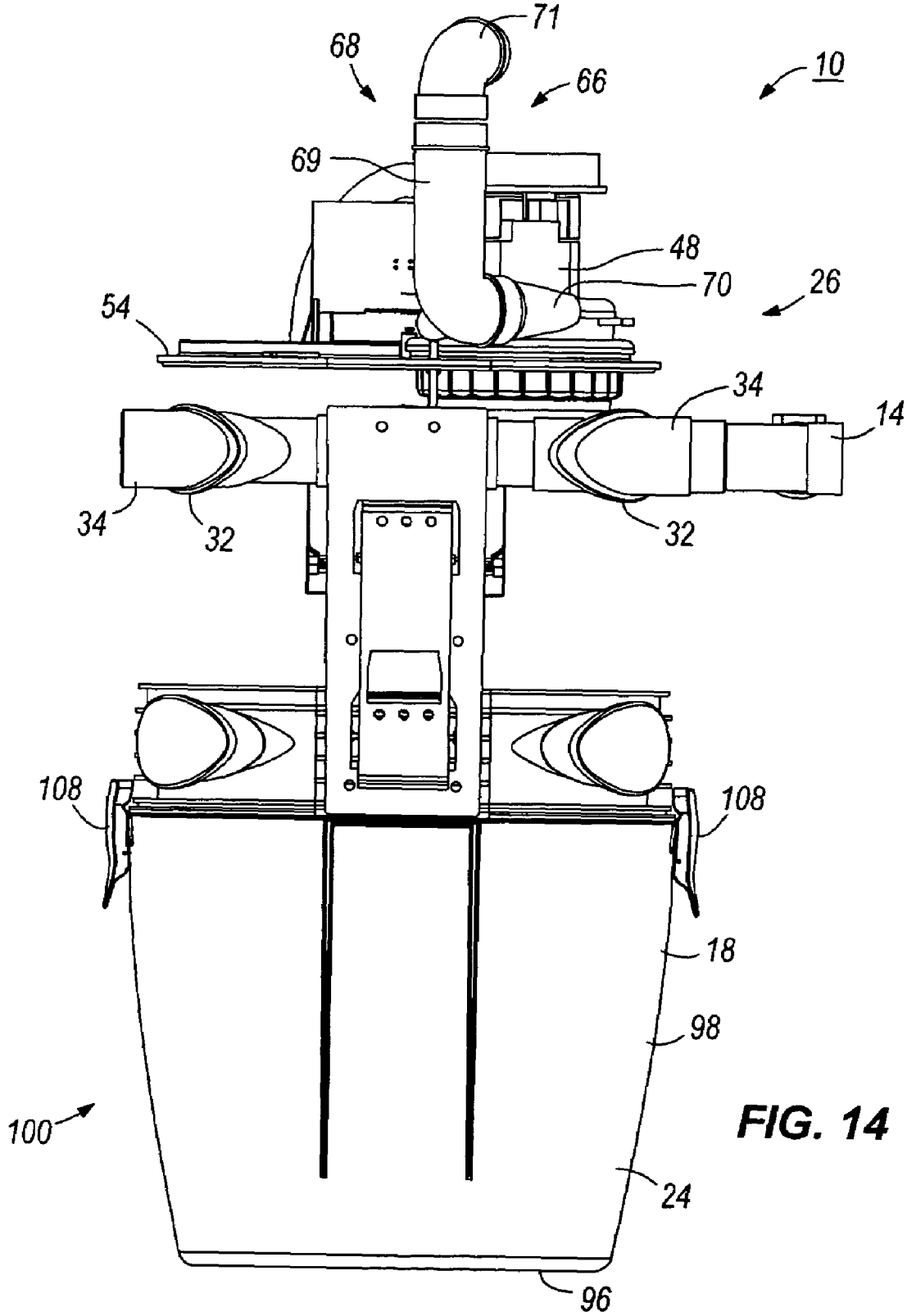
FIG. 14 is a rear view of the vacuum system shown in FIG. 1 with a portion of the housing removed.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "rear", "up", "down", "top", "bottom", and the like) are only used to simplify description of the present invention, and do not alone indicate or imply that the device or element referred to must have a particular orientation. The vacuum system and elements of the vacuum system referred to in the present invention can be installed and operated in any orientation desired. Similarly, the vacuum bag and elements of the vacuum bag referred to in the present invention can be installed and operated in any orientation desired. In addition, terms such as "first", "second", and "third" are used herein and in the appended claims for purposes of description and are not intended to indicate or imply relative importance or significance.

DETAILED DESCRIPTION

FIGS. 1-19G illustrate a portion of a vacuum system 10 and a vacuum bag 12 according to some embodiments of the present invention. The vacuum system 10 can be installed or used in any inhabitable structure, such as, for example, a home, a commercial building, and the like.

As partially shown in FIGS. 1-18, 10-15 and 19A-19F, the vacuum system 10 can include a duct system 14, which extends throughout the structure into various rooms of the structure. Vacuum inlets can be located in various locations throughout the structure and can be in fluid communication with the duct system 14 so that a vacuum hose or nozzle can be connected to the duct system 14. As explained in greater detail below, to operate the vacuum system 10, an operator inserts a hose or nozzle into one of the inlets or actuates a switch adjacent to an inlet. The vacuum system 10 then draws air and debris through the hose, nozzle, or inlet and through the duct system 14 toward a collection area.

The vacuum system 10 can have a housing 18 having any shape desired, such as a round shape, a rectangular, triangular, or other polygonal shape, an irregular shape, and the like. By way of example only, the housing 18 of the illustrated embodiment has a generally elongated configuration and has an elliptical cross sectional shape. In addition, in some embodiments, such as the illustrated embodiment of FIGS. 1-19G, the housing 18 can have a relatively small profile so that the housing 18 can be installed or located in relatively confined areas.

As shown in FIGS. 1-19G, the housing 18 comprises a first module or housing portion 20, a second module or housing portion 22, and a third module or housing portion 24. Together, the first and second modules 20, 22 at least partially define a drive space or motor chamber 26, and together, the second and third housing portions 22, 24 substantially enclose a collection chamber 28. As shown in FIGS. 15, 17, 19B-19E, in some embodiments, the housing 18 can include ribs 30 or other structural supports extending through one or more of the first, second, and third modules 20, 22, 24.

The housing 18 of the central vacuum system 10 can be installed in a number of locations throughout the structure, such as, for example, in the garage, basement, or utility room of a home or a business, or alternatively, the housing 18 can be installed in a closet. To simplify installation and to provide a maximum number of possible installation options, the illustrated embodiment includes a number of inlet openings 32, each of which can be connected to the duct system 14 to fluidly connect the housing 18 (and the vacuum motor 48, which is described in greater detail below) to the duct system 14. In the illustrated embodiment of FIGS. 2, 4-8, 11-14, 17, and 19A, inlets 32 are located on the left and right sides of the housing 18. In other embodiments, inlets 32 can extend through other portions of the housing 18 and can have other orientations to provide further installation options.

During installation, the housing 18 is secured to the structure and the housing 18 is oriented so that one of the inlets 32 can be connected to the duct system 14. A connector 34 is then inserted into the inlet 32 to fluidly connect the housing 18 to the duct system 14 (and the vacuum motor 48, which is described in greater detail below). In some embodiments, such as the illustrated embodiment of FIG. 15, an elastomeric material (e.g., santaprene, neoprene, and polymers of butyl and supronyl, and the like) is positioned between an outer wall of an inlet 32 and the connector 34 to provide a seal and to prevent and/or reduce movement of air and debris between the inlet 32 and the connector 34. In these embodiments, the connector 34 and the elastomeric material can be sealingly connected to the duct system 14 without requiring additional clamps, clamping tools, and other conventional sealing devices and elements, although such sealing devices and elements can also be used. In addition, the connector 34 and the elastomeric material of the illustrated embodiment can be manufactured relatively easily and inexpensively and do not require complex tooling and assembly.

An elastomeric material can also or alternately be positioned between the connector 34 and a portion of the duct system 14 to sealingly connect the connector 34 and the duct system 14. Covers 35 are then placed over the other inlets 32 to seal these inlets 32.

Figure 15:
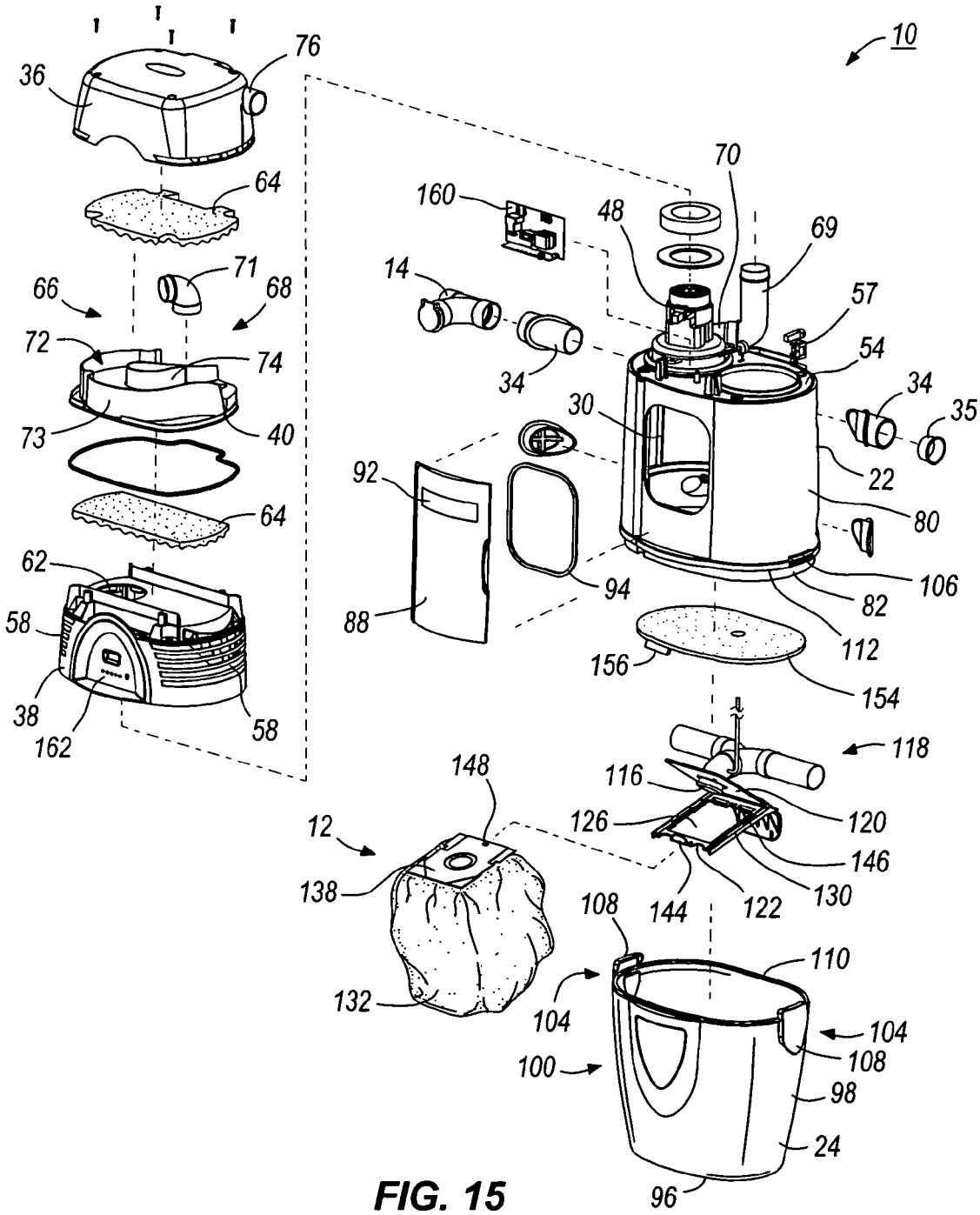
FIG. 15 is an exploded perspective view of the vacuum system shown in FIG. 1.
Figure 17:
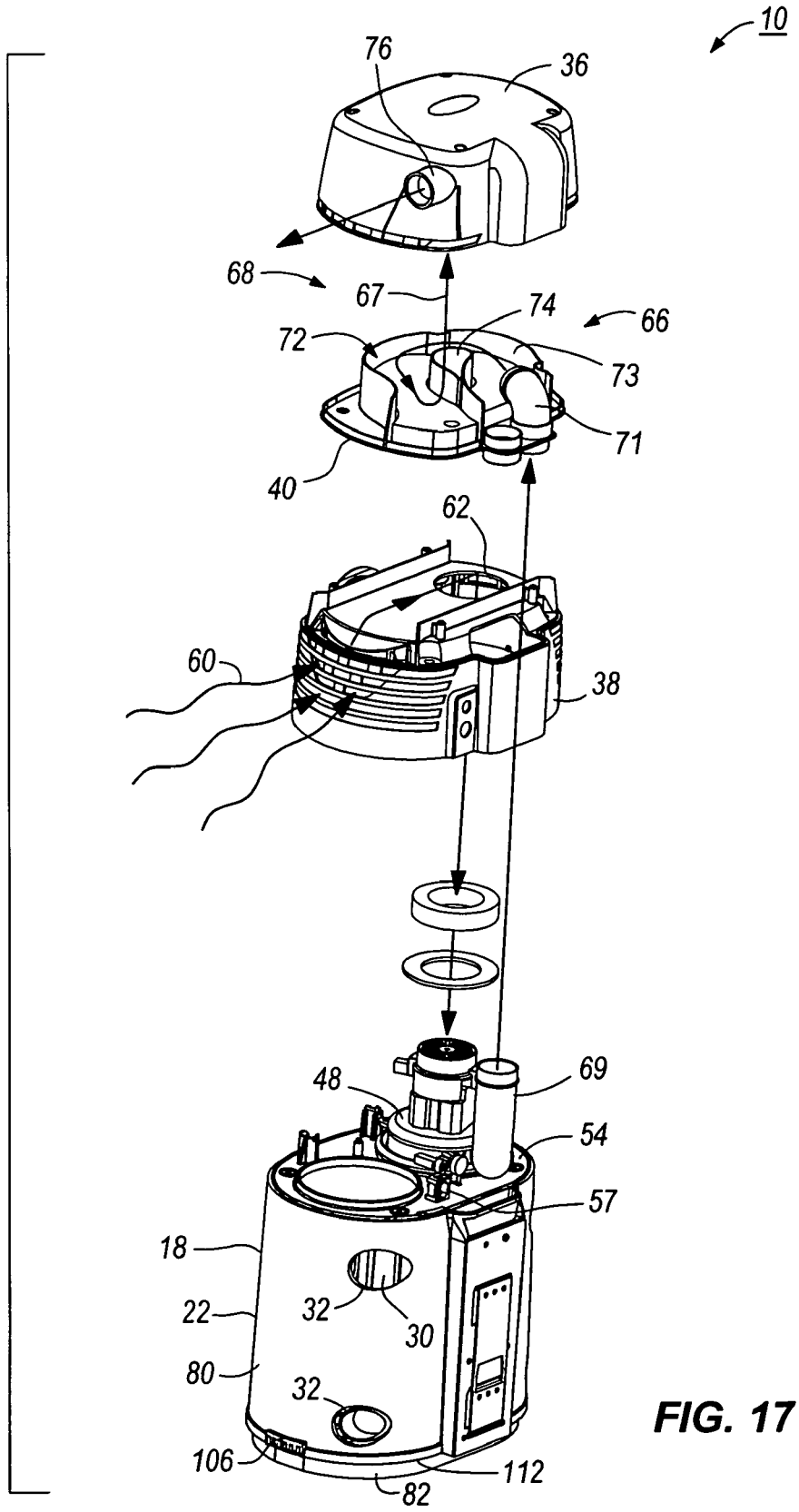
FIG. 17 is an exploded perspective view of a portion of the vacuum shown in FIG. 1 and illustrating air flow through the vacuum system.
Figure 18:
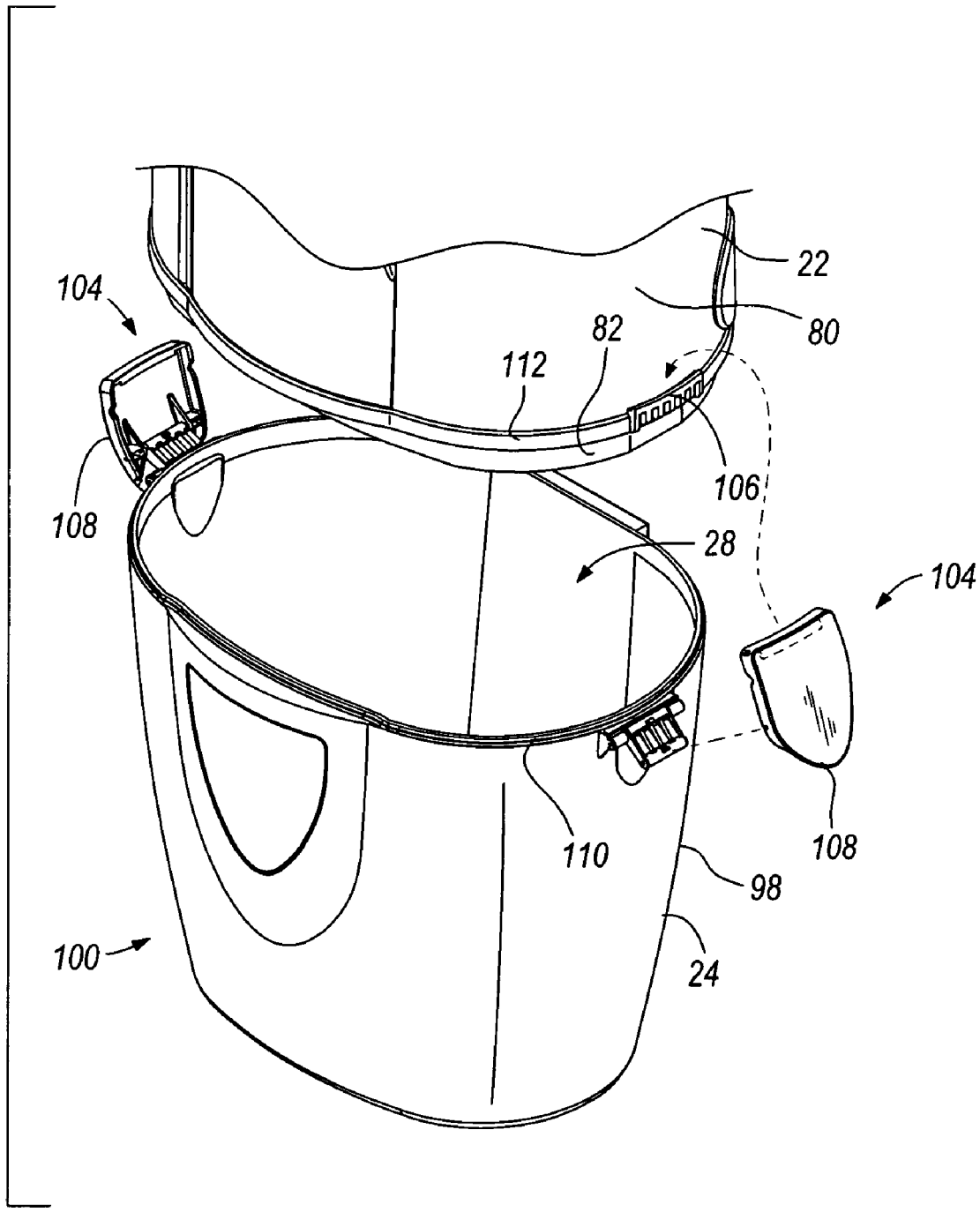
FIG. 18 is an enlarged exploded perspective view of a lower portion of the vacuum system shown in FIG. 1.

As shown in FIGS. 15 and 17, the first module 20 includes a cap 36, a motor cage 38, and a baffle 40 positioned between the cap 36 and the motor cage 38. An upper wall 54 of the second module 22 and the motor cage 38 of the first module 20 substantially enclose the vacuum motor 48 and define a drive space 26 having a substantially elliptical cross sectional shape.

In the embodiment of FIGS. 11-15 and 17, the vacuum motor 48 is positioned on a left side of drive space 26. In other embodiments, the vacuum motor 48 can have other orientations within the drive space 26. For example, the vacuum motor 48 can be positioned in a central location in the drive space 26 or the vacuum motor 48 can be positioned on a right side of the drive space 26.

Figure 20:
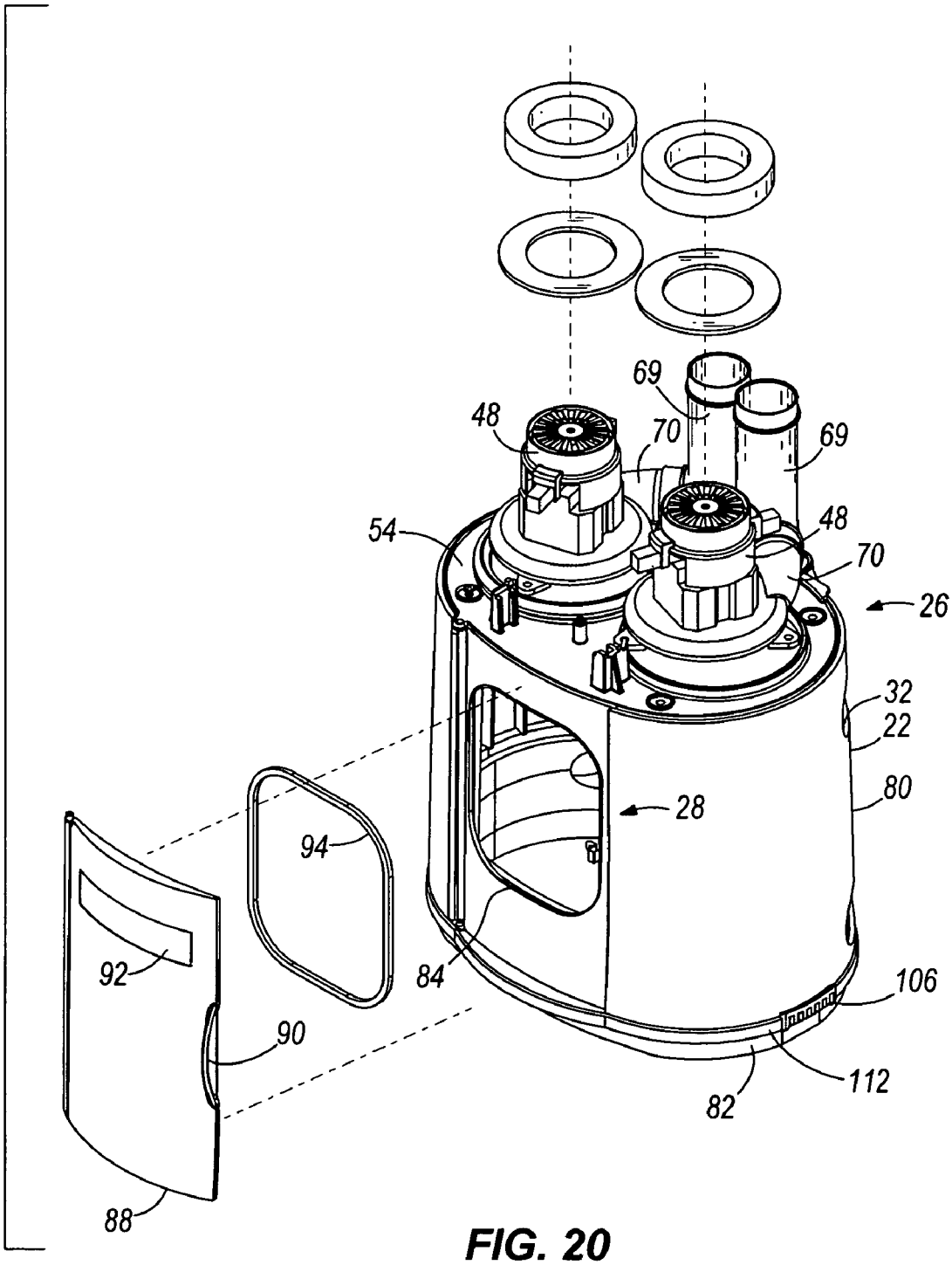
FIG. 20 is a front perspective view of a vacuum system according to another embodiment of the present invention.
Figure 21:
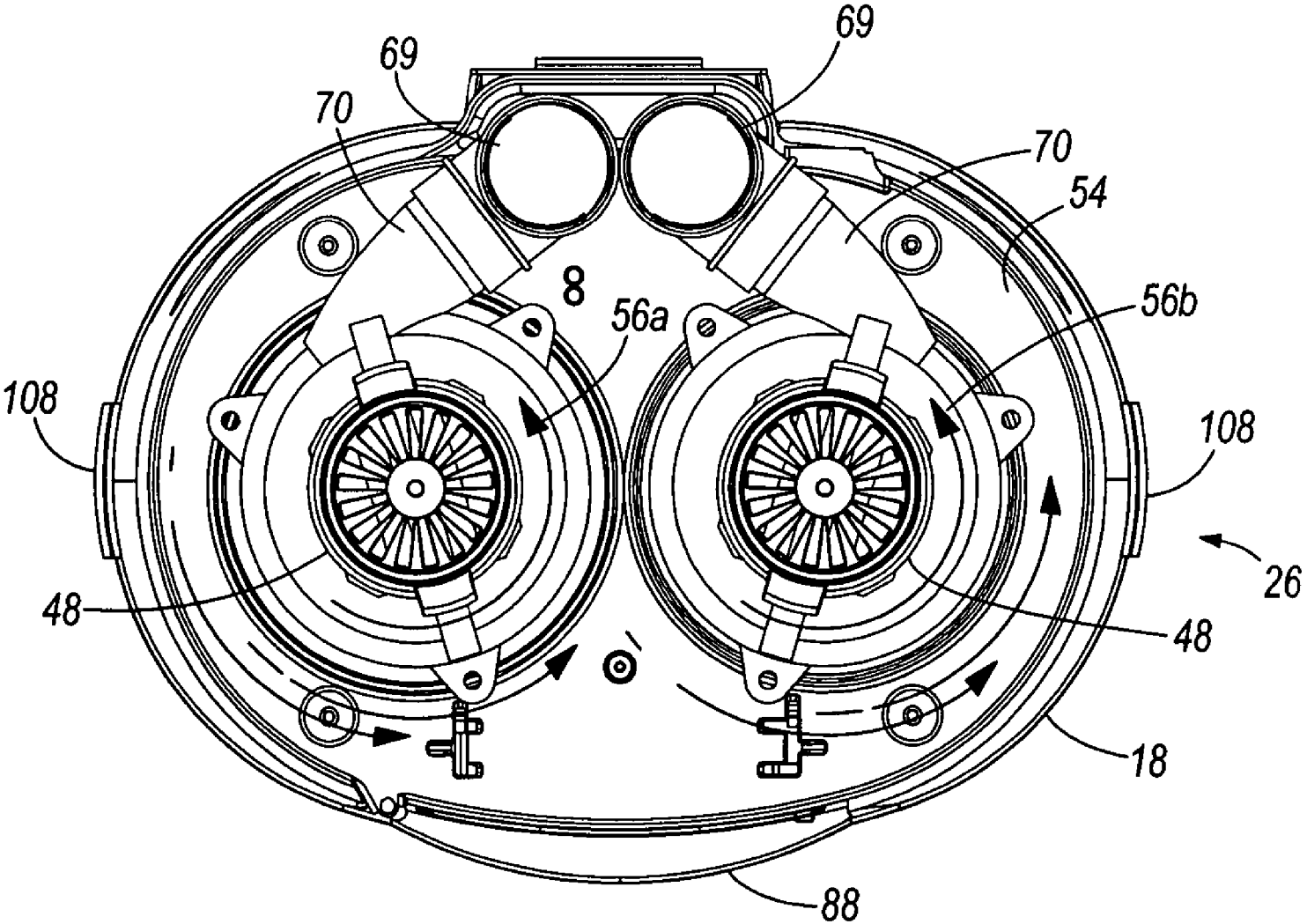
FIG. 21 is a top view of a portion of the vacuum system shown in FIG. 20 and illustrating travel paths of the airflow generated by the vacuum motors of the vacuum system.

In still other embodiments, such as the illustrated embodiment of FIGS. 20 and 21, two or more vacuum motors 48 can be positioned in the drive space 26. In some embodiments having two vacuum motors 48 and having a drive space 26 with an elliptical cross-sectional shape, the vacuum motors 48 can be supported on the upper wall 54 of the second module 22 and can be spaced apart so that airflow generated by one motor 48 does not interfere with airflow generated by the other motor 48. Additionally, in these embodiments, the airflow generated by the motors 48 follows two generally circular travel paths (represented by arrows 56*a*, 56*b* in FIG. 21). As shown in FIG. 21, the travel paths 56*a*, 56*b* extend through substantially the entire drive space 26, thereby preventing the formation of dead spaces wherein the vacuum motors 48 do not generate airflow. Such a construction can improve the efficiency of one or both of the vacuum motors 48 and can reduce noise generation. Some embodiments space two or more vacuum motors 48 close enough that airflow generated by one vacuum motor 48 interferes with the airflow generated by the other motor 48. This interference creates a lower air velocity region that drops debris entrained in the airflow.

In some embodiments, elements of the vacuum system 12, such as, for example, the cap 36, the motor cage 38, the baffle 40, and/or the second module 22, can be constructed so that common elements can be used in constructions of the vacuum system 12 having one or more vacuum motors 48 located in any number of locations in the drive space 26. In these embodiments, no or relatively minor modifications are made to assemble various vacuum systems 12 having a number of different configurations.

In some embodiments, such as the illustrated embodiment of FIGS. 15 and 17, a network (e.g., a wired network, a wireless network, and the like) extends throughout the structure. In these embodiments, the housing 18 can support an electrical adapter 57, which is electrically connectable to the network for communication with control switches positioned throughout the structure. For example, in some embodiments, control switches can be positioned in inlets so that when an operator opens an inlet to connect a hose or nozzle to the duct system, the control switch is triggered, thereby transmitting an activation system through the network to the vacuum motor 48. In other embodiments, control switches can be located on wall switches or in other locations throughout the structure.

With reference to FIGS. 1-6, 8-9, 15, 17, and 19A-19F, cooling vents 58 can extend through the housing 18 to cool the vacuum motor 48. In the illustrated embodiment, the cooling vents 58 extend through the motor cage 38 and the cap 36 and communicate between atmosphere and the drive space 26. In operation, air is drawn into the drive space 26 through the cooling vents 58 as represented by arrows 60 in FIG. 17. The air is then drawn through the drive space 26 between an upper surface of the motor cage 38 and a lower surface of the baffle 40 before being drawn downwardly through an opening 62 in the upper surface of the motor cage 38 and into the vacuum motor 48.

In some embodiments, acoustic dampening material (e.g., elastomeric materials, such as, for example, polyester, polyurethane, melamine, and the like) 64 can be positioned in the drive space 26 to absorb noise generated by air flowing through the drive space 26. In the illustrated embodiment of FIG. 15, acoustic dampening material 64 is secured to the undersides of the baffle 40 and the cap 36. In other embodiments, acoustic dampening material 64 can be positioned in other locations in the drive space 26 to absorb noise generated by air flowing through the drive space 26.

The vacuum system 10 can also include an exhaust system 66, which provides an exit for air exhausted from the vacuum motor 48. As shown in FIG. 17, exhaust air (represented by arrows 67) exits the vacuum motor 48 and is directed upwardly and outwardly through the exhaust system 66 toward the atmosphere. The vacuum system 10 can also include an acoustic dampening system 68 positioned along the exhaust system 66 for absorbing noise generated by exhaust air exiting the housing 18 through the exhaust system 66.

In the illustrated embodiment of FIGS. 15 and 17, the exhaust system 66 and the acoustic dampening system 68 include a conduit 70 and a muffler 69, which direct exhaust air 67 upwardly and outwardly from the vacuum motor 48 and dampen noise generated by the exhaust air 67. As shown in FIG. 17, the muffler 69 extends through openings in the cap 36 and the baffle 40.

The exhaust system 66 and the acoustic dampening system 68 of the illustrated embodiment also include an elbow 71 connected to a downstream end of the muffler 69 and a dampening chamber 72 defined between a first dampening wall 73 and a second dampening wall 74. As shown in FIG. 17, the elbow 71 directs the exhaust air 67 laterally into the dampening chamber 72, which provides a substantially U-shaped path for exhaust air 67. In other embodiments, the first and second dampening walls 73, 74 can have other shapes and orientations to provide other non-linear paths (e.g., semicircular, L-shaped, and the like) for the exhaust air 67. In addition, in some embodiments, such as the illustrated embodiment of FIG. 17, portions of the dampening chamber 72, including the first and second dampening walls 73, 74 and the underside of the cap 36, can also include or be covered with acoustic dampening material (e.g., elastomeric materials, such as, for example, polyester, polyurethane, melamine, and the like) to absorb noise generated by the exhaust air 67. From the dampening chamber 72, the exhaust system 66 and the acoustic dampening system 68 of the illustrated embodiment direct the exhaust air 67 outwardly through an opening 76 in the cap 36 toward the atmosphere.

As mentioned above, portions of the second and third modules 22, 24 substantially enclose the collection chamber 28. The second module 22 defines an upper portion of the collection chamber 28 and includes an upper wall 54 and a side wall 80 having a downwardly extending ridge 82. An opening 84 extends through the side wall 80 and provides access to the collection chamber 28 and, in embodiments having vacuum bags 12, provides access to vacuum bags 12 located in the collection chamber 28. In some embodiments, the opening 84 also provides access to other elements and systems of the vacuum system 10, such as, for example, the vacuum motor 48 and the controller 160 (described below) so that operators can perform maintenance operations.

In some embodiments, such as the illustrated embodiment of FIGS. 1-3, 15, and 19A-19F, the second module 22 includes a door 88, which is connected to the side wall 80. As shown in FIGS. 19A-19F, the door 88 is moveable relative to the side wall 80 between a closed position, in which the door 88 substantially covers the opening 84, and an opened position, in which the door 88 is moved away from the opening 84. In the illustrated embodiment of FIGS. 1-3, 15, and 19A-19F, the door 88 also includes a handle 90 for moving the door 88 between the opened and closed positions and a viewing window 92 so that operators can view the contents of the collection chamber 26 (e.g., the vacuum bag 12 and/or debris collected in the collection chamber 28) without having to open the door 88.

As shown in FIGS. 15 and 19B-19E, the second module 22 can also include a seal or gasket 94 secured in the opening 84, or alternatively, secured to the door 88 for movement with the door 88 relative to the side wall 80. In these embodiments, the gasket 94 provides a seal and prevents and/or reduces movement of air and debris through the opening 84 when the door 88 is in the closed position.

The third module 24 defines the lower portion of the collection chamber 28 and includes a bottom wall 96 and a side wall 98. Together, the bottom and side walls 96, 98 can define a pail 100, which is operable to collect and contain debris and/or support a vacuum bag 12. In some embodiments, the third module 24 can also support one or more replacement bags 12. In other embodiments, replacement bags 12 can be housed in other locations throughout the housing 18.

In some embodiments, the vacuum system 10 can include a locking assembly 104 for securing the third module 24 to the second module 22. In the illustrated embodiment of FIGS. 1-15, 18, and 19A-19G, the vacuum system 10 includes two locking assemblies 104 positioned between the second and third modules 22, 24. In other embodiments, the vacuum system 10 can include one, three, or more locking assemblies 104.

The locking assembly 104 of the illustrated embodiment of FIGS. 1-15, 18, and 19A-19G include protrusions 106 extending outwardly from the side wall 80 of the second module 22 and latches 108 connected to the side wall 98 of the third module 24. In other embodiments, the locking assemblies 104 can include protrusions 106 extending outwardly from the side wall 98 of the third module 24 and latches 108 connected to the side wall 80 of the second module 22. In other embodiments, the locking assembly 104 can include other inter-engaging elements and fasteners, such as for example, screws, nails, rivets, pins, posts, clips, clamps, and any combination of such fasteners.

With reference to the illustrated embodiment of FIGS. 1-15, 18, 19A-19G, the latches 108 are pivotably connected to the side wall 98 for movement between locking positions (shown in FIGS. 1-14), in which the latches 108 lockingly engage the protrusions 106 to secure the third module 24 to the second module 22, and unlocking positions (not shown), in which the latches 108 are moved away from and out of engagement with the protrusions 106, thereby allowing the third module 24 to be separated from the second module 22.

In some embodiments, such as the illustrated embodiment of FIGS. 1-19G, the locking assemblies 104 are operable to lift the third module 24 from a floor, table, or shelf and to move the third module 24 toward the second module 22. In these embodiments, an operator positions the third module 24 under the second module 22 and positions the upper ends of the latches 108 on the protrusions 106. The operator then pivots the latches 108 downwardly from the unlocking positions toward the locking positions to lift the third module 24 upwardly and into engagement with the second module 22.

Figure 19B:
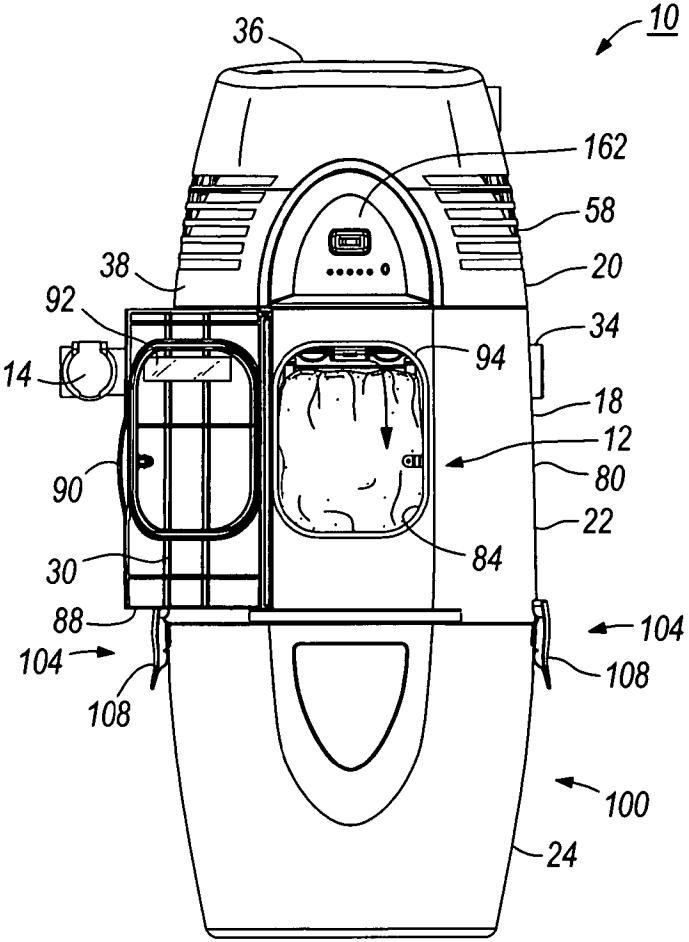
FIGS. 19A-19G illustrate a method of removing a bag from a vacuum system according to the present invention.
Figure 19A:
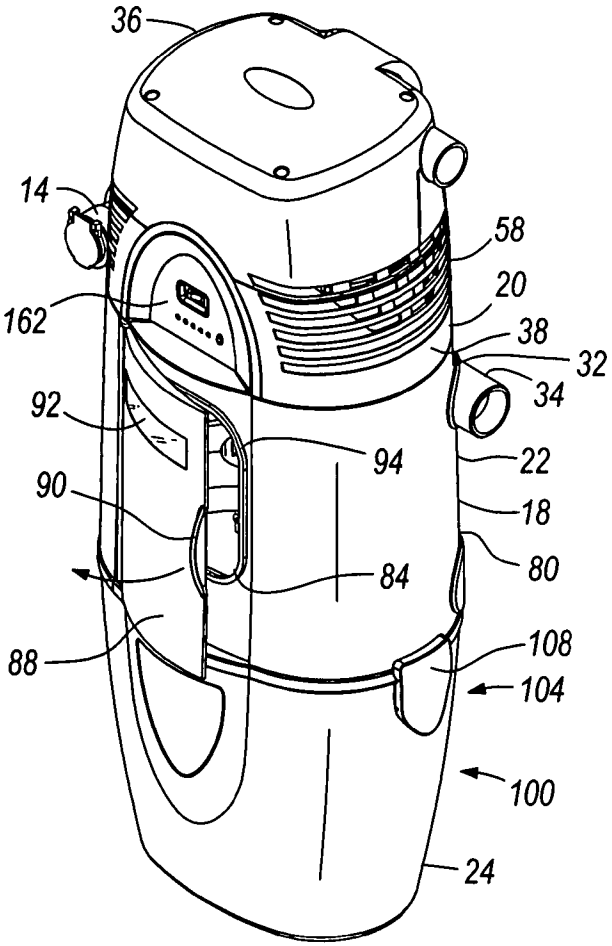
Figure 19D:
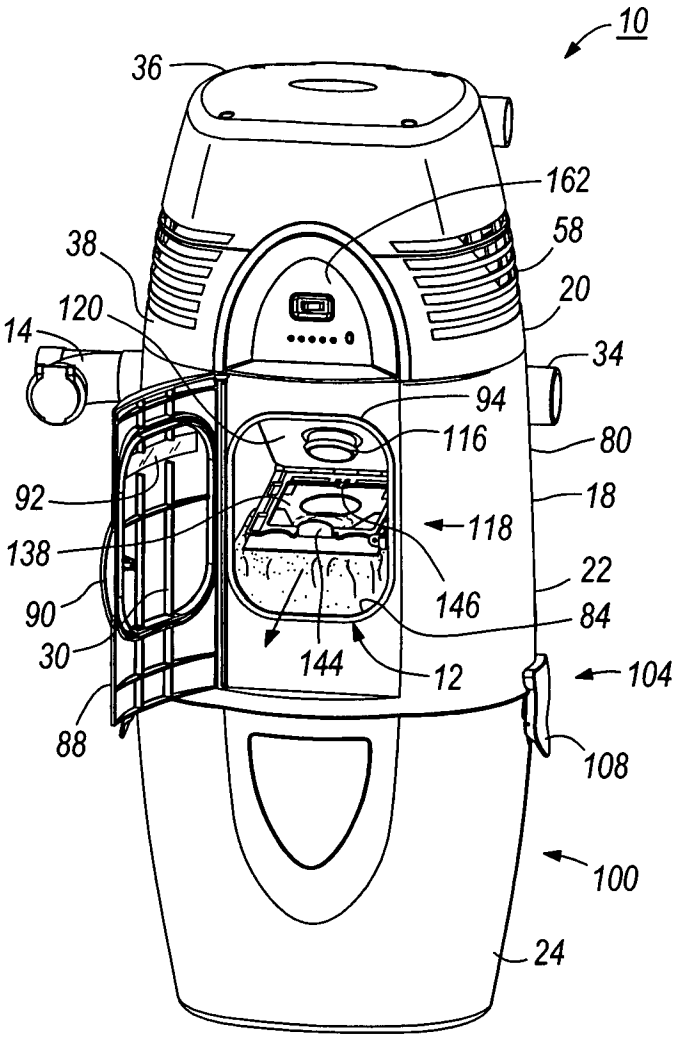
Figure 19C:
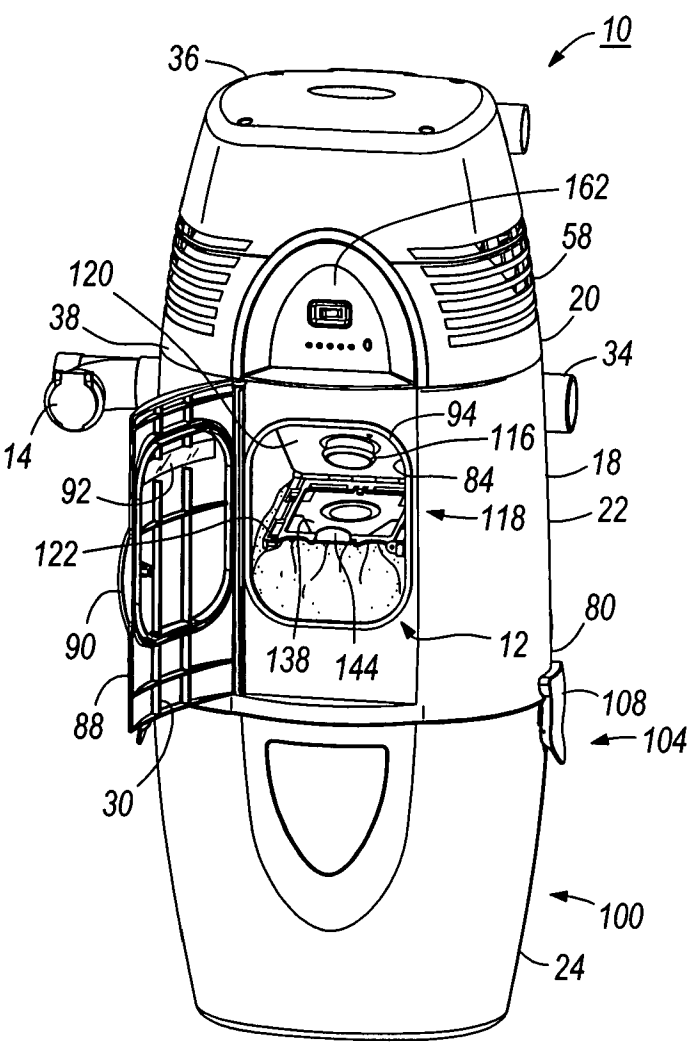
Figure 19F:
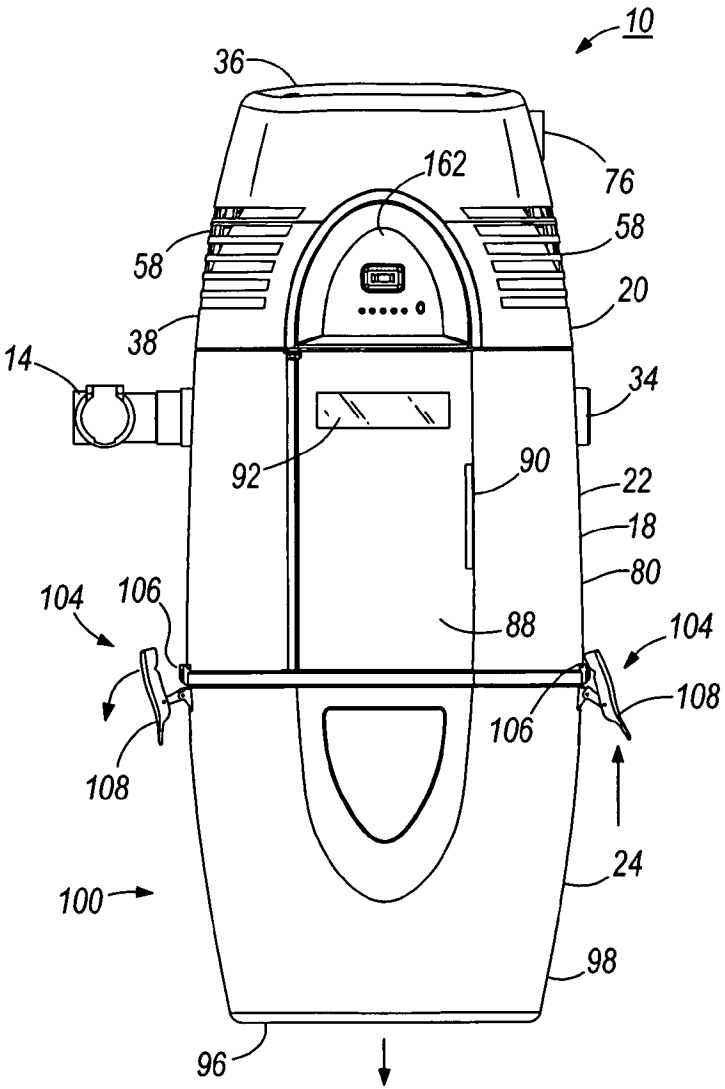
Figure 19E:
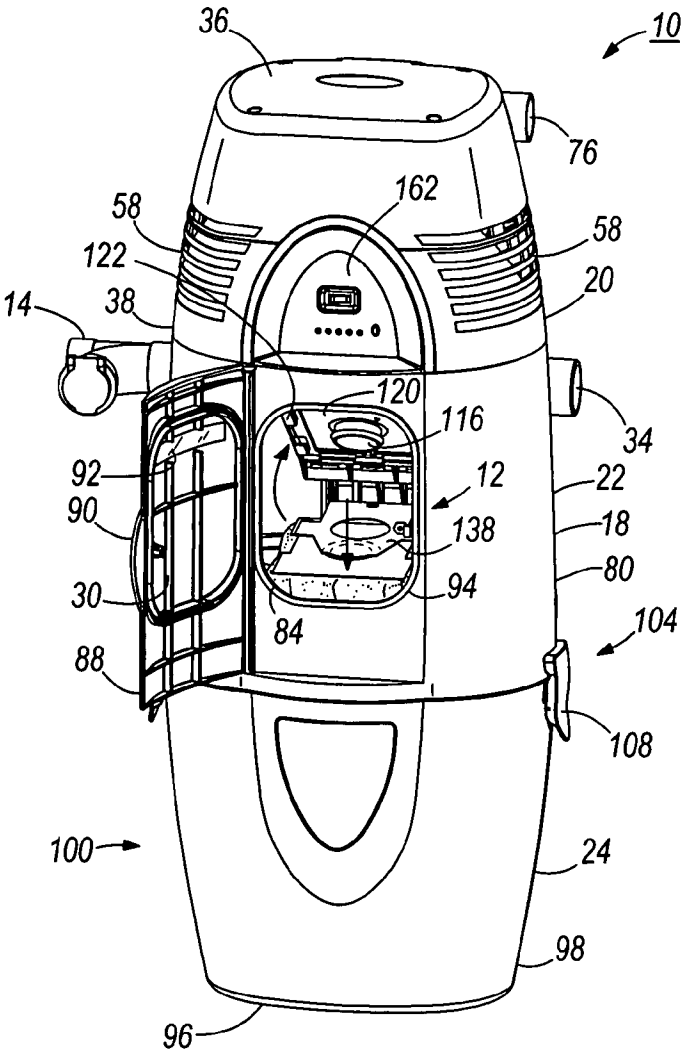
Figure 19G:
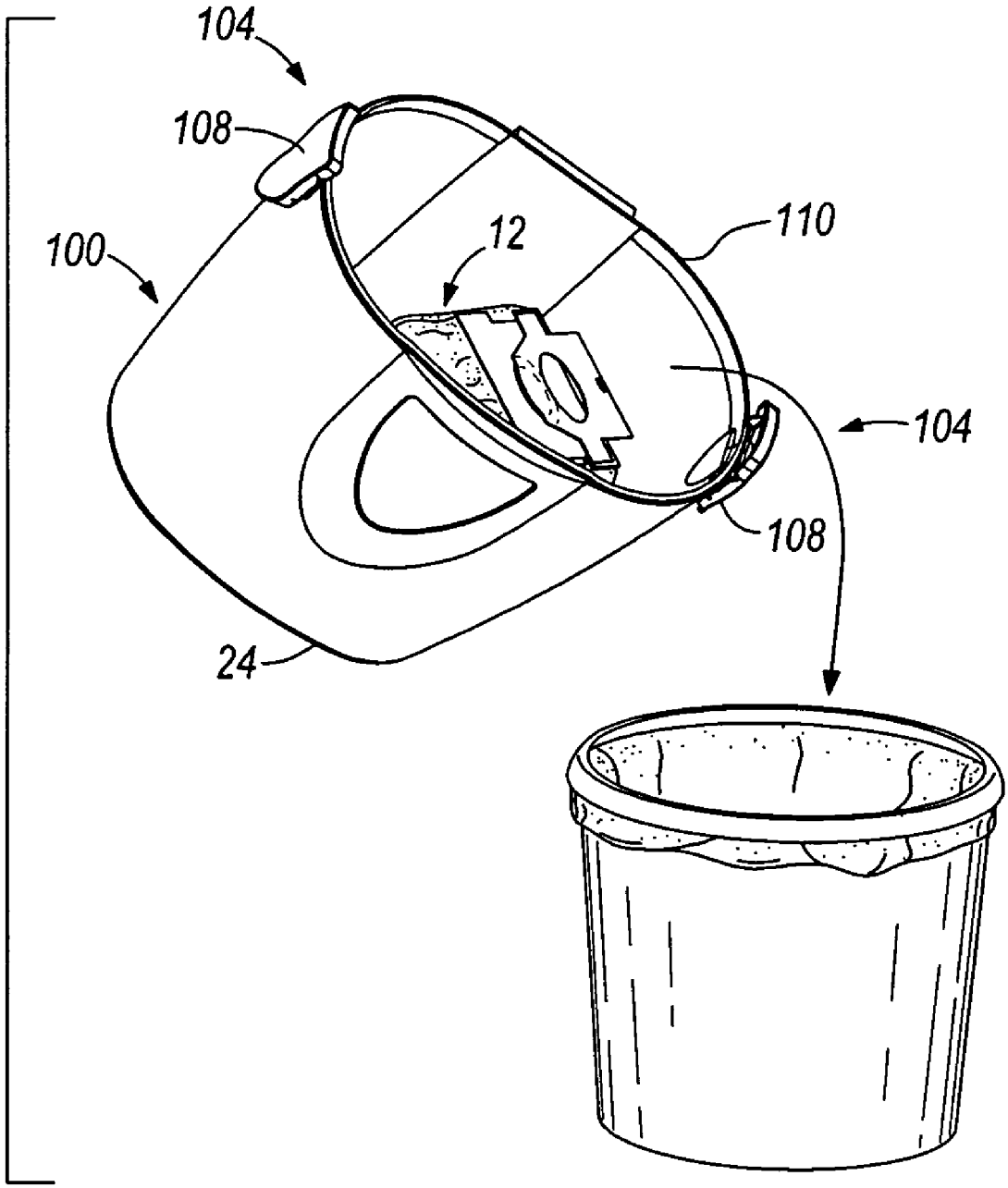

As shown in FIGS. 15 and 19G, a lip 110 extends upwardly from the side wall 98 of the third module 24 and is engageable with the ridge 82 and the side wall 80 of the second module 22 to form a seal between the second and third modules 22, 24 and to prevent and/or reduce movement of air and debris between the second and third modules 22, 24. In some embodiments, the vacuum system 10 can also include a gasket or seal 112 positioned between the lower end of the second module 22 and an upper end of the third module 24.

The vacuum system 12 can also include an adapter 116, which extends into the collection chamber 28 and is engageable with a vacuum bag 12 to fluidly connect the vacuum motor 48 and the duct system 14 to the vacuum bag 12. As shown in FIGS. 15 and 19C-19E, the adapter 116 can extend through an upper portion of the second module 22 and can be oriented to direct debris downwardly into the collection chamber 28 and/or the bag 12. In other embodiments, the adapter 116 can have other orientations and can extend through other portions of the collection chamber 28.

The vacuum system 10 can also include a bag mounting assembly 118, which extends into the upper portion of the collection chamber 28 and is operable to support a vacuum bag 12 in the housing 18. In some embodiments, such as the illustrated embodiment of FIGS. 11, 12, 15, and 19C-19E, the bag mounting assembly 118 includes a mounting plate 120, which is connected to the adapter 116 and the side wall 80 of the second module 22, and a bag plate 122, which is pivotably connected to the side wall 98 of the second module 22 for pivoting movement relative to the side wall 80 and the mounting plate 120 between a locking position, in which the bag plate 122 is adjacent to the mounting plate 120, and an unlocking position, in which at least a portion of the bag plate 122 is moved away from the mounting plate 120.

In the illustrated embodiment of FIG. 15, the bag plate 122 defines a central opening 126 and includes rails 130 located on opposite sides of the opening 126. In some embodiments, a bag 12 or a portion of a bag 12 can be inserted through the opening 126 in the bag plate 122 and the bag plate 122 can be moved from the unlocking position toward the locking position to trap or lock the bag 12 or a portion of the bag 12 between the bag plate 122 and the mounting plate 120 and to connect the bag 12 to the adapter 116.

Figure 15A:
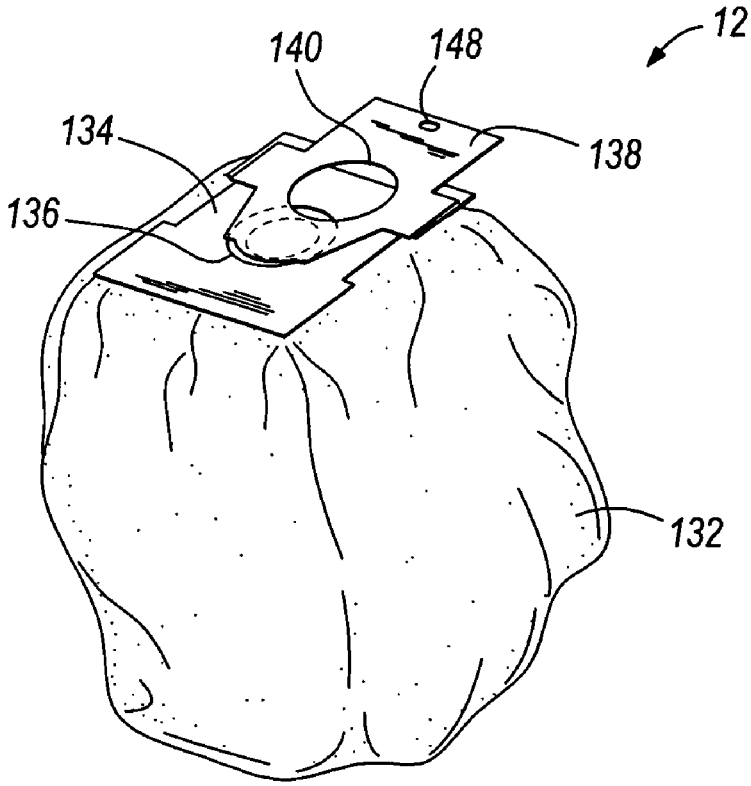
FIG. 15A is an enlarged perspective view of the vacuum bag shown in FIG. 15.
Figure 16:
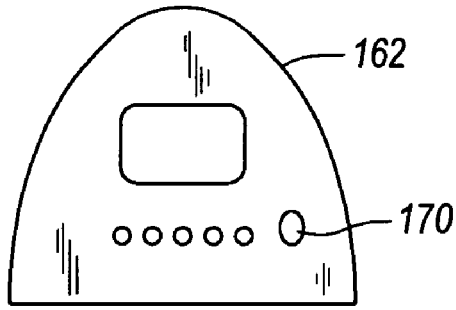
FIG. 16 is an enlarged front view of a control panel of the vacuum system shown in FIG. 1 with a portion of the housing removed.

In the illustrated embodiment of FIG. 15A, the vacuum bag 12 includes a body 132 enclosing an interior space and having an opening through which debris can pass. The bag 12 also includes a flange 134 positioned adjacent to the opening in the body 132. The flange 134 defines an inlet 136 and supports a cover 138 for sliding movement relative to the flange 134. As shown in FIG. 15A, the cover 138 includes an opening 140 and is moveable relative to the flange 134 between an opened position, in which the opening 140 of the cover 138 is substantially aligned with the inlet 136 of the flange 134, and a closed position, in which the opening 140 of the cover 138 is moved out of alignment with the inlet 136 of the flange 134 so that at least a portion of the cover 138 substantially covers the inlet 136 of the flange 134.

In embodiments, such as the illustrated embodiment of FIGS. 1-15 in which the bag 12 includes a flange 134, the flange 134 can be secured to the bag plate 122 for movement with the bag plate 122 between the locking position and the unlocking position. In these embodiments, the flange 126 is inserted between the rails 130 and is moved rearwardly along the rails 130 into engagement with the bag plate 122. The bag plate 122 can then be moved from the unlocking positioned toward the locking position to secure the bag 12 to the adapter 116 so that at least a portion of the adapter 116 extends through the opening 140 of the cover 138 and the inlet 136 of the flange 140 to direct debris into the bag 12. Once the bag plate 122 is moved toward the locking position, a latch or fastener 144 can secure the bag plate 122 to the mounting plate 118.

In some embodiments, such as the illustrated embodiment of FIGS. 1-19E, the bag mounting assembly 118 can include a protrusion 146, which extends outwardly from the bag plate 122 and which is engageable in a recess 148 in the cover 138 of the bag 12. As shown in FIGS. 15A, 19C, and 19D, when the flange 134 is inserted into the bag plate 122, the protrusion 146 engages the recess 148 so that when the flange 134 is removed from the bag plate 122, the engagement between the protrusion 146 of the bag plate 122 and the recess 148 of the cover 138 will cause the cover 138 to move relative to the flange 134 between the opened position and the closed position. In this manner, at least a portion of the cover 138 can be moved across the inlet 136 in the flange 134 before the bag 12 is removed from the collection chamber 28, thereby preventing debris from exiting the bag 12 through the inlet 136 as the bag 12 is removed from the vacuum system 10.

As shown in FIG. 15, the vacuum system 10 can also include a filter 154 positioned between the vacuum motor 48 and the vacuum bag 12. In these embodiments, the filter 154 substantially prevents debris from moving from the collection chamber 28 into the drive space 26, thereby preventing debris from moving from the collection chamber 28 into the vacuum motor 48 or from a bag 12 located in the collection chamber 28 into the vacuum motor 48. The filter 154 can also prevent debris from entering the drive space 26 when a bag 12 located in the collection chamber 28 is punctured or torn.

In some embodiments, such as the illustrated embodiment of FIG. 15, the filter 154 is removeably secured in the collection chamber 28 between brackets and is accessible through the opening 84 in the side wall 88 of the second module 22. In these embodiments, an operator can open the door 80 to clean or change the filter 154 when the filter 154 becomes soiled, or alternatively, an operator can clean the filter 154 each time the operator inserts a new bag 12 into the collection chamber 28 or each time the operator removes debris from the collection chamber 28.

To facilitate filter replacement, the filter 154 can include a tab 156, which extends downward into the collection chamber 28. In these embodiments, the tab 156 is oriented to be accessible through the opening 84.

In some embodiments, an operator can clean the filter 154 by inserting a hand into the collection chamber 28 through the door 88 and tapping or shaking the filter 154. Debris trapped in the filter 154 will then fall to the bottom of the collection chamber 26.

The vacuum system 10 can also include a controller 160 operable to control and monitor operation of the vacuum system 10 and a display panel 162 for displaying system data relating to the operation of the vacuum system 10. In the illustrated embodiment of FIGS. 1-15, the controller 160 is located in the first module 20 and the display panel 162 is positioned on the outer wall of the motor cage 38. In other embodiments, the controller 160 and the display 162 can have other orientations and can be supported in other locations in the housing 18.

The vacuum system 10 can also include a number of sensors 164 distributed throughout the housing 18 for monitoring and controlling operation of the vacuum system 10. In the illustrated embodiment of FIG. 11, a pressure sensor 164 is supported in the collection chamber 28 and is connected to the controller 160 to transmit pressure data to the controller 160. In embodiments having pressure sensors 164, the controller 160 is operable to calculate the volume of debris collected in the collection chamber 28 and/or the volume of debris collected in a bag 12 supported in the collection chamber 28 using the data received from the pressure sensor 164. Alternatively or addition, the controller 160 can calculate the volume of empty space or debris capacity remaining in the collection chamber 28 or in a bag 12 supported in the collection chamber 28.

In these embodiments, a base pressure value corresponding to an empty collection chamber 28 or empty bag 12 is stored in the controller memory unit. As the collection chamber 28 or a bag 12 supported in the collection chamber 28 is filled, the air pressure in the collection chamber 28 increases. The pressure sensor 164 records these increases and transmits the pressure data to the controller 160. The controller 160 continuously compares the pressure data from the sensor 164 to the base pressure value to calculate the volume of debris in the collection chamber 28 or in a bag 12 supported in the collection chamber 28. Alternatively or in addition, the controller 160 continuously compares the pressure data from the sensor 164 to the base pressure value to calculate the volume of empty space or capacity remaining in the collection chamber 28 or in a bag 12 supported in the collection chamber 28 as debris is collected.

In other embodiments, a maximum pressure value corresponding to a full collection chamber 28 or a full bag 12 is stored in the controller memory unit. In operation, the pressure sensor 164 records the increases in pressure as debris is collected in the collection chamber 28, or alternatively, in a bag 12 supported in the collection chamber 28. The pressure sensor 164 transmits the pressure data to the controller 160 and the controller 160 continuously compares the pressure data from the sensor 164 to the maximum pressure value to calculate the volume of debris in the collection chamber 28 or in a bag 12 supported in the collection chamber 28. Alternatively or in addition, the controller 160 continuously compares the pressure data from the sensor 164 to the maximum pressure value to calculate the volume of empty space or capacity remaining in the collection chamber 28 or in a bag 12 supported in the collection chamber 28 as debris is collected.

In some embodiments, the display panel 162 displays the remaining capacity in the collection chamber 28 or in the bag 12 supported in the collection chamber 28, or alternatively, displays the volume of debris in the collection chamber 28 or in the bag 12 supported in the collection chamber 28. In the illustrated embodiment of FIGS. 1-3, 11-13, 15, 16, 19A-19F, the display panel 162 includes a number of lights (e.g., light emitting diodes or "LEDs"), which are illuminated to inform the operator of the remaining capacity or to inform the operator of the volume of debris collected. For example, the display panel 162 can include one or more green lights, one or more amber lights, and one or more red lights, which are sequentially illuminated to indicate the changing collection chamber capacity. In other embodiments, the display panel 162 can include other indicators or display screens (e.g., a video screen, a liquid crystal display, or the like) which are operable to display data corresponding to collection chamber capacity.

It has been found that, in some embodiments, the vacuum motor 48 can become overheated and/or damaged when the vacuum system 10 is operated after the collection chamber 28 or a bag 12 supported in the collection chamber 28 is filled to a maximum allowable capacity.

In some embodiments, the controller 160 is operable to shutdown the vacuum motor 48 when the collection chamber 28 or a bag 12 supported in the collection chamber 28 is fill to prevent damage to the vacuum motor 48. In these embodiments, a maximum allowable pressure value corresponding to a maximum allowable capacity of debris is stored in the controller memory unit. When the pressure sensor 164 records a pressure value in the collection chamber 28 which is greater than or equal to the maximum allowable pressure value, the controller 160 shuts down the vacuum motor 48. Alternatively or in addition, the controller 160 can be programmed to display a warning message or to activate a warning light when the pressure sensor 164 records a pressure value in the collection chamber 28 which is greater than or equal to the maximum allowable pressure value.

In some embodiments, the vacuum system 10 includes temperature sensors 168, which are positioned in the drive space 26 and are operable to record the temperature of the vacuum motor 48. In these embodiments, a maximum temperature value corresponding to a maximum allowable motor temperature is stored in the controller memory unit. When the temperature sensor 168 records a temperature value in the drive space 26 which is greater than or equal to the maximum allowable temperature, the controller 160 shuts down the vacuum motor 48 to prevent or reduce damage to the vacuum motor 48. Alternatively or in addition, the controller 160 can be programmed to display a warning message or to activate a warning light when the temperature sensor 168 records a temperature value in the collection chamber 28 which is greater than or equal to the maximum allowable temperature value.

In other embodiments, other sensors can be positioned in the collection chamber 28 to record data corresponding to the capacity of the collection chamber 28 or a bag 12 supported in the collection chamber 28 to monitor operation of the vacuum system 10. For example, the vacuum system 12 can include microphones positioned in the collection chamber 28. In these embodiments, sound data is transmitted from the microphones to the controller 160 and the controller 160 calculates the capacity of the collection chamber 28 or a bag 12 supported in the collection chamber 28.

The controller 160 can also include a timer. In these embodiments, a maximum motor operation time is stored in the controller memory unit and the controller 160 is programmed to alert the operator or shut down the vacuum motor 48 when the vacuum motor 48 is operated longer than the maximum motor operation time. For example, the controller 160 can be programmed to shut down the vacuum motor 48 if the vacuum motor 48 is continually operated for 3 hours. Alternatively or in addition, the controller 160 can be programmed to shut down the vacuum motor 48 when the vacuum motor 48 is operated for more than 3 hours during a 4 hour period.

In embodiments having a timer, the controller 160 can be programmed to estimate the length of time the vacuum motor 48 is operated between bag replacements or occasions in which the collection chamber 28 is emptied. In these embodiments, the controller 160 can be programmed to progressively illuminate lights on the control panel 162 corresponding to the length of time the vacuum motor 48 has been operated between bag replacements or occasions in which the collection chamber 28 is emptied. For example, in some embodiments, the controller 160 is programmed to illuminate a first green light after one hour of vacuum motor operation, a second green light after a second hour of vacuum motor operation, an amber light after a third hour of vacuum motor operation, and a red light after a fourth hour of vacuum motor operation.

In embodiments having a controller 160, the vacuum system 10 can also include a reset button 170. In the illustrated embodiment of FIG. 16, the reset button 170 is located on the display panel 162. In other embodiments, the reset button 170 can be located in other locations on the housing 18. In still other embodiments, the reset button 170 can be located on the hose which is connected to the duct system 14 so that the operator can reset the vacuum system 10 without having to walk to the housing 18.

In embodiments having a reset button 170, an operator can press the reset button 170 to restart the vacuum motor 48 after replacing the full vacuum bag 12 with a new bag 12 or after the operator empties the collection chamber 28. In embodiments having a pressure sensor 164, the controller 160 can be programmed to record a new pressure value in the collection chamber 28 after the reset button 170 has been pressed. If after being shut down, the pressure sensor 146 again records a pressure value greater than the maximum allowable pressure value, the controller 160 can be programmed to shut down the vacuum motor 48 or to alert the operator. In other embodiments having other sensors, such as, for example, temperature sensors or microphones, the controller 160 can be programmed to record new values after the reset button 170 is pressed and to compare these new values to predetermined maximum values. If the new values remain greater than the predetermined allowable values, the controller 160 can be programmed to shut down the vacuum motor 48 a second time, or alternatively, to alert the operator (e.g., by illuminating a warning light on the display panel 162.

In embodiments having a bag mounting assembly 118 for supporting a vacuum bag 12, an operator opens the door 88 to insert a new bag 12 into the collection chamber 28. The operator then pivots the bag plate 122 downwardly from the locking position toward the unlocking position. Next, the operator inserts a vacuum bag 12 into the collection chamber 28 so that the body 132 extends downwardly into the third module 24 and aligns the flange 134 of the vacuum bag 12 with the rails 130 of the bag plate 122. The operator then moves the flange 134 into engagement with the bag plate 122. As the flange 134 is engaged with the bag plate 122, the cover 138 is moved forwardly with respect to the flange 134 to align the opening 140 in the cover 138 with the inlet 136 in the flange 134 and to engage the protrusion 146 of the bag mounting assembly 118 in the recess 148 in the cover 138.

The operator next pivots the bag plate 122 upwardly toward the locking position, moving the flange 134 into engagement with the adapter 116 so that at least a portion of the adapter 116 extends through the inlet 136 in the flange 134 and through the opening 140 in the cover 138. The operator then secures the bag plate 122 in the locking position with the latch 144 and closes the door 88, sealing the bag 12 in the collection chamber 28.

The operator can then operate the vacuum system 10 in a conventional manner to draw debris into a hose, nozzle, or other port and through the duct system 14 toward the adapter 116, which directs the debris into the vacuum bag 12.

Over time, the vacuum system 10 fills the bag 12 with debris. In embodiments of the vacuum system 10 having a controller 160 and a display panel 162, the controller can be operable to alert the operator when the bag 12 is filled and when bag replacement is necessary, as mentioned above. Alternatively or in addition, the operator can open the door 88 to determine when bag replacement is necessary or the operator can look through the viewing window 92 in the door 88 to determine when bag replacement is required.

When bag replacement is required, the operator shuts down the vacuum motor 48 and opens the door 88. The operator then grasps the latch 144 to unlock the bag assembly 118 and pivots the bag plate 122 and the bag flange 134 downwardly toward the unlocking position. The operator then slides the bag flange 134 forwardly along the rails 130 and away from the bag mounting assembly 118.

As the bag flange 134 is moved away from the bag mounting assembly 118, the protrusion 146 on the bag mounting assembly 118 remains engaged in the recess 148 in the cover 138, causing the cover 138 to move relative to the flange 134 from the opened position toward the closed position so that the cover 138 extends across and substantially covers the inlet 136 in the flange 134. The operator then removes the bag flange 134 from the bag mounting assembly 118 and lets the bag 12 fall to the bottom of the collection chamber 28 (i.e., the bottom of the third module 24).

Next, the operator moves the locking assemblies 104 from the locking positions toward the unlocking positions and removes the third module 24 (and consequently the bag 12 supported in the third module 24) from the second module 22. The operator can then remove the bag 12 from the third module 24 and dispose of the bag 12 in a conventional manner.

Once the bag 12 has been removed, the operator reconnects the third module 24 to the second module 22 and moves the locking assemblies 104 toward the locking positions to secure the third module 24 to the second module 22. The operator can then insert a new bag 12 into the collection chamber 28, as explained above.

In embodiments not having a bag mounting assembly 118 for supporting a vacuum bag 12, the operator operates the vacuum system 10 in a conventional manner to draw debris into a hose or nozzle and through the duct system 14 toward the adapter 116, which directs the debris into the collection chamber 28.

Over time, the vacuum system 10 fills the collection chamber 28 with debris. In embodiments of the vacuum system 10 having a controller 160 and a display panel 162, the controller can be operable to alert the operator when the collection chamber 28 is filled and when it is necessary to empty the collection chamber 28, as mentioned above. Alternatively or in addition, the operator can open the door 88 to determine when it is necessary to empty the collection chamber 28, or alternatively, the operator can look through the viewing window 92 in the door 88 to determine when it is necessary to empty the collection chamber 28.

When it is necessary to empty the collection chamber 28, the operator shuts down the vacuum motor 48. The operator then moves the locking assemblies 104 from the locking positions toward the unlocking positions and removes the third module 24 (and the debris contained in the third module 24) from the second module 22. The operator can then empty the third module 24 and dispose of the debris in a conventional manner.

Once the debris has been removed from the third module 24, the operator reconnects the third module 24 to the second module 22 and moves the locking assembly 104 toward the locking position to secure the third module 24 to the second module 22. The operator can then resume operation of the vacuum system 10.

Figure 22:
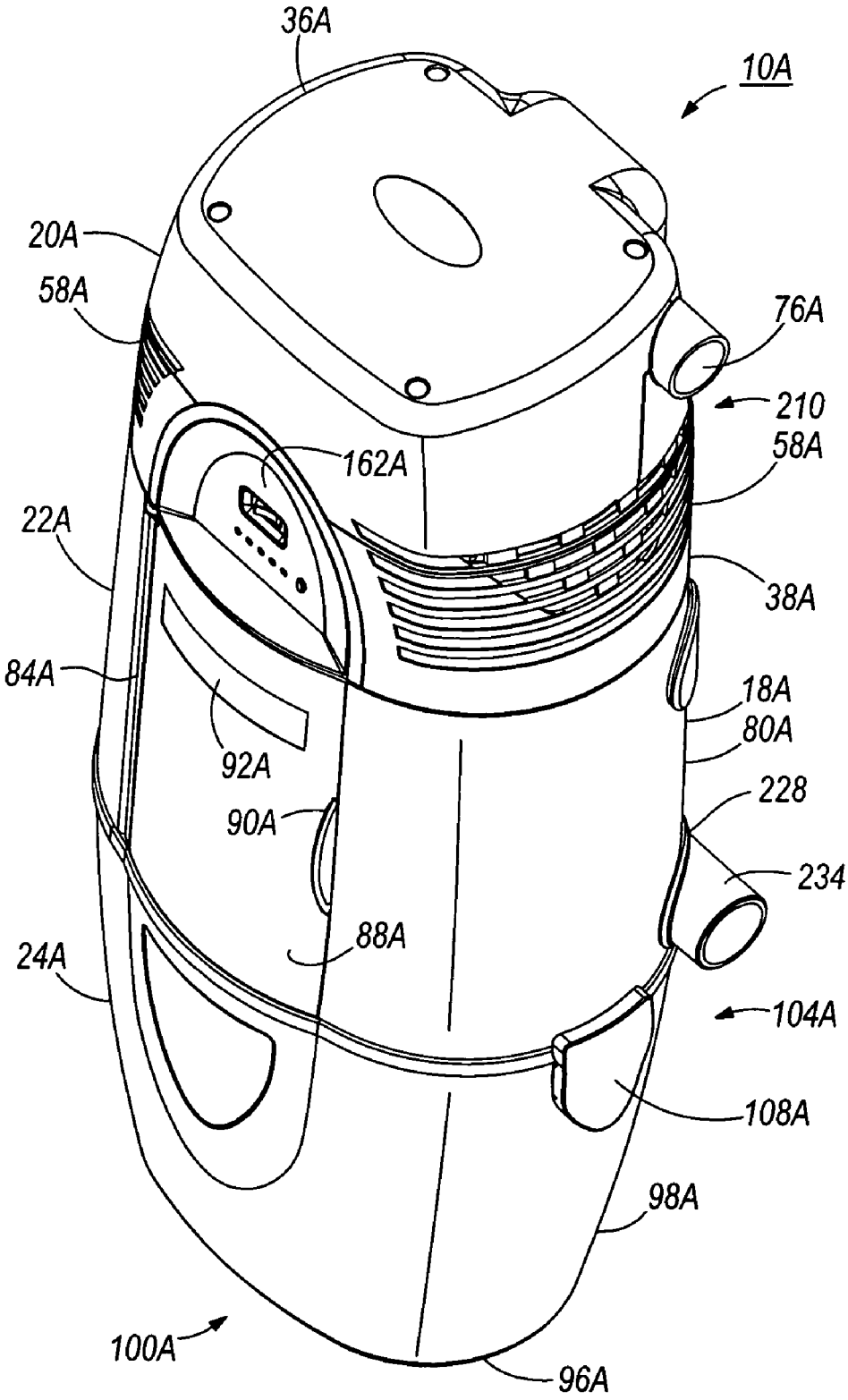
FIG. 22 is a front perspective view of a vacuum system according to still another embodiment of the present invention.
Figure 23:
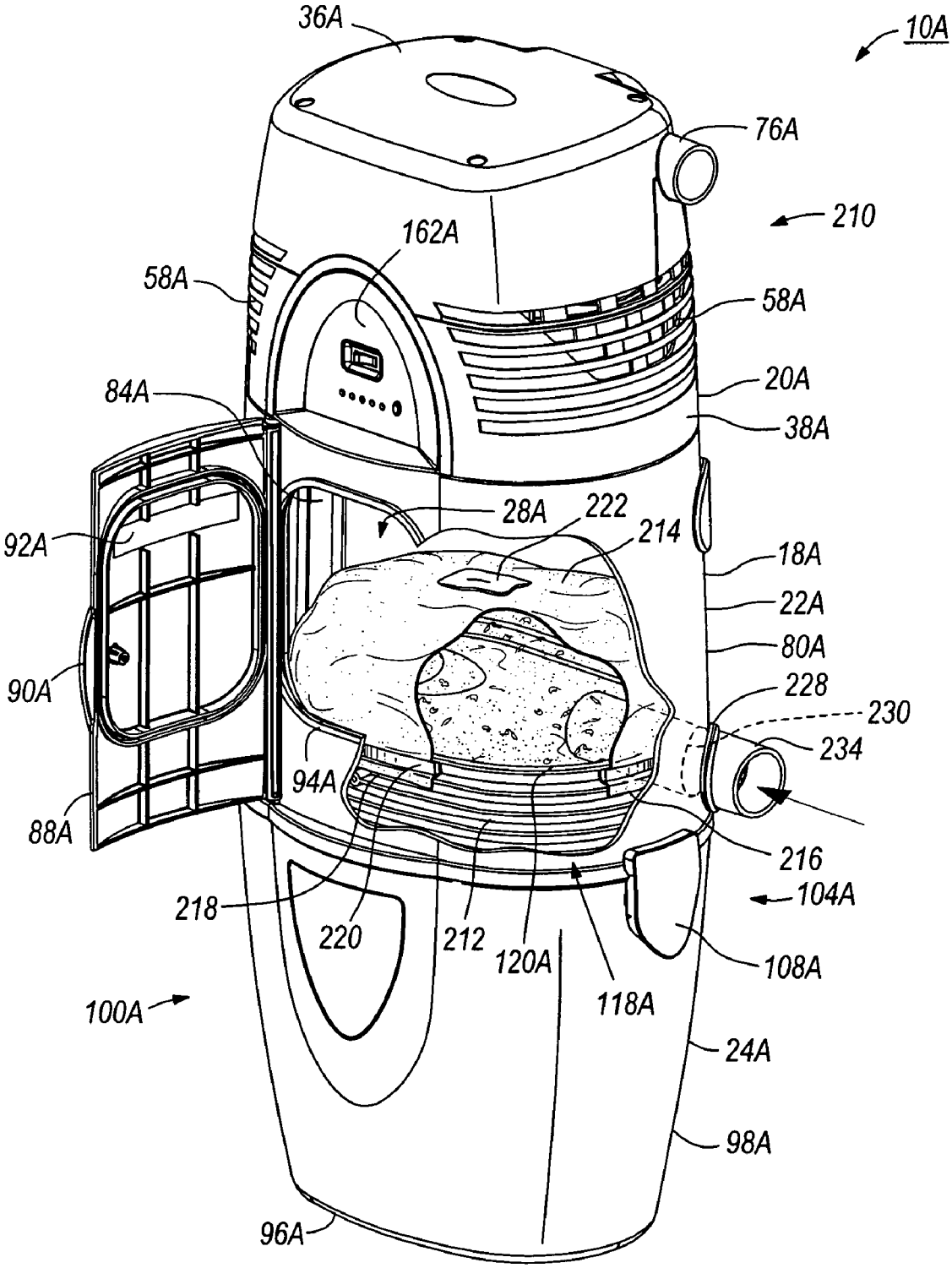
FIG. 23 is a front perspective view of the vacuum system shown in FIG. 22.

FIGS. 22 and 23 illustrate another embodiment of the vacuum system 10A according to the present invention. The vacuum system 10A in FIGS. 22 and 23 is similar in many ways to the illustrated embodiments of FIGS. 1-21 described above. Accordingly, with the exception of mutually inconsistent features and elements between the embodiment of FIGS. 22 and 23 and the embodiments of FIGS. 1-21, reference is hereby made to the description above accompanying the embodiments of FIGS. 1-21 for a more complete description of the features and elements (and the alternatives to the features and elements) of the embodiment of FIGS. 22 and 23. Features and elements in the embodiment of FIGS. 22 and 23 corresponding to features and elements in the embodiments of FIGS. 1-21 are identified by the same reference number and the letter "A".

FIGS. 22-23 illustrate a vacuum system 10A having a housing 18A, which defines a first module 20A, a second module 22A, and a third module 24A. Together, the first and second modules 20A, 22A at least partially define a drive space or motor chamber 26A. Together, the second and third housing portions 22A, 24A substantially enclose a collection chamber 28A.

In some embodiments, such as the illustrated embodiment of FIGS. 22 and 23, the vacuum system 10A includes a cyclonic drive system 210, including a vacuum motor 48A, which is operable to draw debris through the duct system 14 and into the collection chamber 28A. In other embodiments, other drive systems, including conventional vacuum drive systems can also or alternately be used.

As shown in FIGS. 22 and 23, the second module 22A defines an upper portion of the collection chamber 28A and includes an upper wall 54A and a side wall 80A. An opening 84A extends through the side wall 80A and provides access to the collection chamber 28A and to a filter 12A supported in the collection chamber 28A. In some embodiments, such as the illustrated embodiment of FIGS. 22 and 23, a door 88A is connected to the side wall 80A and is moveable relative to the side wall 80A between a closed position, in which the door 88A substantially covers the opening 84A, and an opened position, in which the door 88A is moved away from the opening 84A.

The third module 24A defines the lower portion of the collection chamber 28A and includes a bottom wall 96A and a side wall 98A. Together, the bottom and the side walls 96A, 98A can define a pail 100A, which is operable to collect and contain debris. As shown in the illustrated embodiment of FIGS. 22 and 23, the vacuum system 10A can include a locking assembly 104A for securing the third module 24A to the second module 22A.

The vacuum system 10A can also include a filter mounting assembly 118A for supporting a filter 12A in the collection space 28A. In the illustrated embodiment of FIGS. 22 and 23, the filter mounting assembly 118A includes a generally cylindrical mounting plate 120A secured to the side wall 80A of the second module 22A and extending circumferentially around the collection chamber 28A. In other embodiments, the mounting plate 120A can have other shapes and can be positioned in other locations in the collection chamber 28A. As shown in FIG. 23, the mounting plate 120A can also include a number of radially extending ribs 212.

As shown in FIG. 23, a filter 12A formed of a flexible or elastomeric material can be secured to the mounting plate 120A and can include a body 214 enclosing an interior space and an edge 216 defining an opening 218. In the illustrated embodiment, shown in FIG. 23, a fastener 220, such as, an elastic band, secures the edge 216 of the filter 12A to the mounting plate 120A between the ribs 212 for movement relative to the mounting plate 120A between an inflated orientation, in which at least a portion of the filter 12A extends upwardly from the mounting plate 12A through the collection chamber 28A, and a deflated orientation, in which the filter 12A hangs downwardly from the mounting plate 120A through a lower portion of the collection chamber 28A. In other embodiments, other conventional fasteners can be employed to secure the filter 12A to the mounting plate 120A as just described, such as pins, posts, clips, clamps, interengaging elements, and any combination of such fasteners.

As shown in FIG. 23, the filter 12A can include a weight 222, which is secured to a lower end of the filter 12A and is operable to maintain the filter 12A in the deflated orientation when the vacuum system 10 is not in operation.

In some embodiments, the side wall 80A of the second module 22A defines an inlet 228 communicating between atmosphere and the collection chamber 28A. In embodiments of the vacuum system 10A having a mounting plate 120A, such as the illustrated embodiment of FIGS. 22 and 23, the mounting plate 120A can also define an opening 230, which is generally aligned with the inlet in the second wall 80A. As shown in FIGS. 22 and 23, a conduit 234 extends radially through the inlet 228 in the side wall 80A of the second module 22A and, in embodiments having a mounting plate 120A, through the opening 230 into the collection chamber 28A.

During operation, an operator connects a hose or nozzle to the duct system 14 and activates the vacuum motor 48A, which operates to draw debris and air through the duct system 14 and into the collection chamber 28A through the conduit 234. In embodiments of the vacuum system 10A having a filter mounting assembly 118A and a filter 12A supported in the collection chamber 28A, air and debris entering the collection chamber 28A move the filter 12A relative to the mounting plate 120A from the deflated orientation toward the inflated orientation. The filter 12A can then operate as a filter, allowing air to move upwardly through the collection chamber 28A and outwardly toward the exhaust system 66A while preventing debris from exiting the collection chamber 28A. In addition, the filter 12A can prevent or reduce movement of debris from the collection chamber 28A into the drive space 26A.

In embodiments, such as the illustrated embodiment of FIGS. 22 and 23 having a cyclonic drive system 210, air and debris entering the collection chamber 28A is directed along a generally circular flow path within the collection chamber 28A. In these embodiments, centrifugal forces cause the debris to be separated from the air. In other embodiments, the vacuum system 10A can include other conventional drive systems and filter systems, which can operate to separate the debris from the air in the collection chamber 28A.

To remove debris from the collection chamber 28A, the operator shuts down the vacuum motor 48A and removes the third module 24A from the second module 22A. The operator can then empty the third module 24A and dispose of the debris in a conventional manner.

In embodiments, such as the illustrated embodiment of FIGS. 22 and 23 having a filter mounting assembly 118A and a filter 12A, the operator can open the door 88A and can reach into the collection chamber 28A through the opening 84A. The operator can then tap an upper or clean side of the filter 12A to dislodge any debris accumulated on the filter 12A. The debris will then drop into the third module 24A and can be disposed as described above.

Various alternatives and embodiments are contemplated as being within the scope of the following claims particularly pointing out and distinctly claiming the subject matter regarded as the invention.

What is claimed is:

1. A central vacuum system connectable to an interior portion of an inhabitable structure, the central vacuum system comprising:

a housing having an upper portion, a lower portion removably secured to the upper portion, and a side wall defining a collection chamber, the side wall defining an opening communicating between atmosphere and the collection chamber;

a vacuum motor supported in the housing and being operable to move debris from the interior portion into the collection chamber; and a bag supported in the collection chamber, the bag being accessible through the opening.

2. The central vacuum system of claim 1, wherein the side wall supports a door for movement relative to the housing between a closed position, in which the door substantially covers the opening, and an opened position, in which the door is moved away from the opening.

3. The central vacuum system of claim 1, wherein the bag includes a flange, and further comprising an adapter extending into the collection chamber and being engageable with the flange to fluidly connect the bag to the vacuum motor.

4. The central vacuum system of claim 3, wherein the adapter is accessible through the opening.

5. The central vacuum system of claim 1, further comprising a bag mounting assembly extending into the collection chamber for supporting the bag.

6. The central vacuum system of claim 5, wherein the bag mounting assembly is accessible through the opening.

7. The central vacuum system of claim 1, further comprising a locking assembly operable to removably secure the lower portion to the upper portion.

8. The central vacuum system of claim 1, wherein the lower portion includes an outer wall, and further comprising a bag supported in the collection chamber, the vacuum motor being operable to direct debris into a space between the bag and the outer wall of the lower portion.

9. The central vacuum system of claim 1, wherein the housing is configured to be secured to the inhabitable structure, the bag being accessible through the opening when the central vacuum system is secured to the inhabitable structure.

10. The central vacuum system of claim 1, wherein the housing includes a display panel on a first side of the housing, and wherein the opening is positioned on the first side of the housing.

11. A central vacuum system connectable to an interior portion of a structure, the central vacuum system comprising:

a housing having a wall defining a collection chamber;

a bag mounting assembly extending into the collection chamber;

a bag having a flange connectable with the bag mounting assembly to secure the bag in the collection chamber, the flange defining an inlet and supporting a cover, the cover being moveable relative to the flange between a closed position, in which the cover substantially covers the inlet, and an opened position, in which at least a portion of the cover is moved away from the inlet; and a vacuum motor supported in the housing and being operable to move debris from the interior portion into the bag;

wherein the cover is connectable to the bag mounting assembly so that, when the flange is removed from the bag mounting assembly, the cover is moved between the opened position and the closed position.

12. The central vacuum system of claim 11, wherein the cover assembly is moveable between the opened position and the closed position while at least a portion of the bag is positioned in the collection chamber.

13. The central vacuum system of claim 11, wherein one of the cover and the bag mounting assembly defines an aperture and the other of the cover and the bag mounting assembly includes a protrusion engageable in the aperture.

14. The central vacuum system of claim 11, wherein the bag mounting assembly is pivotably connected to the housing wall for movement relative to the wall.

15. The central vacuum system of claim 11, wherein moving the cover between the opened position and the closed position helps prevent debris from exiting the bag when the bag is removed from the collection chamber.

16. The central vacuum system of claim 11, wherein the cover defines an aperture, and wherein, when the cover is moved toward the opened position, the aperture is substantially aligned with the inlet of the flange.

17. The central vacuum system of claim 11, further comprising an adapter extending into the collection chamber and being engageable with the flange to fluidly connect the bag to the vacuum motor.

18. The central vacuum system of claim 17, wherein the bag mounting assembly is pivotably connected to the housing wall for movement relative to the wall between a locking position, in which the adapter is engageable with the flange, and an unlocking position, in which the flange is moveable away from the adapter.

19. The central vacuum system of claim 11, wherein the wall includes an upper end, a lower end, and a side wall, and wherein, the side wall defines an opening communicating between atmosphere and the collection chamber.

20. The central vacuum system of claim 19, wherein the bag is accessible through the opening.

21. The central vacuum system of claim 19, wherein the bag mounting assembly is accessible through the opening.

22. A method of operating a central vacuum system connectable to an interior portion of an inhabitable structure, the central vacuum system including a housing having an upper portion, a lower portion, and a side wall defining a collection chamber, the side wall defining an opening communicating between atmosphere and the collection chamber, the method comprising the acts of:

providing a vacuum motor supported in the housing;

inserting a bag into the collection chamber through the opening in the side wall;

directing debris from the interior portion into the bag with the vacuum motor;

disconnecting the lower portion of the housing from the upper portion of the housing; and removing the bag, having debris therein, from the collection chamber.

23. The method of claim 22, wherein the central vacuum system includes a door, and further comprising moving the door relative to the side wall between a closed position, in which the door substantially covers the opening, and an opened position, in which the door is moved away from the opening.

24. The method of claim 22, wherein the vacuum system includes a locking assembly, and wherein disconnecting the lower portion of the housing from the upper portion of the housing includes moving the locking assembly between a locking position, in which the locking assembly secures the lower portion of the housing to the upper portion of the housing, and an unlocking position, in which the lower portion of the housing is moveable relative to the upper portion of the housing.

25. The method of claim 22, wherein the vacuum system includes an adapter extending into the collection chamber, and wherein inserting the bag into the collection chamber through the opening in the side wall includes connecting the bag to the adapter.

26. A method of operating a central vacuum system connectable to an interior portion of an inhabitable structure, the central vacuum system including a housing having a wall defining a collection chamber, a vacuum motor supported in the housing, and a bag mounting assembly extending into the collection chamber, the method comprising the acts of:

inserting a bag into the collection chamber, the bag having a flange defining an inlet and supporting a cover;

connecting the flange to the bag mounting assembly;

moving the cover relative to the flange toward an opened position, in which the cover is moved away from the inlet;

connecting the cover to the bag mounting assembly;

moving debris from the interior portion into the bag with the vacuum motor;

disconnecting the flange from the bag mounting assembly; and removing the bag from the collection chamber;

wherein, when the flange is disconnected from the bag mounting assembly, the cover is moved relative to the flange between the opened position and a closed position, in which the cover substantially covers the inlet.

27. The method of claim 26, wherein one of the cover and the bag mounting assembly defines an aperture and the other of the cover and the bag mounting assembly includes a protrusion, and wherein connecting the cover to the bag mounting assembly includes engaging the protrusion in the aperture.

28. The method of claim 26, wherein the vacuum system includes an adapter extending into the collection chamber, and wherein connecting the flange to the bag mounting assembly includes engaging the adapter in the inlet.

29. The method of claim 28, wherein the bag mounting assembly is pivotably connected to the housing wall, and wherein connecting the flange to the bag mounting assembly includes moving the bag mounting assembly relative to the wall between a locking position, in which the adapter is engageable with the flange, and an unlocking position, in which the flange is moveable away from the adapter.

30. The method of claim 26, wherein the cover defines an aperture, and wherein moving the cover relative to the flange toward the opened position includes substantially aligning the aperture of the cover with the inlet of the flange.

31. The method of claim 26, wherein the housing includes an upper end, a lower end, wherein the wall extends between the upper end and the lower end and defines an opening communicating between atmosphere and the collection chamber, and wherein inserting the bag into the collection chamber includes inserting the bag through the opening in the wall.

32. The method of claim 26, wherein the housing includes an upper portion and a lower portion connected to the upper portion, and wherein removing the bag from the collection chamber includes disconnecting the lower portion from the upper portion.

* * * * *